US006804479B2

(12) United States Patent
Kimura

(10) Patent No.: US 6,804,479 B2
(45) Date of Patent: Oct. 12, 2004

(54) IMAGE FORMING APPARATUS WITH TEST PATTERN FOR IMAGE CONTROL

(75) Inventor: Yoichi Kimura, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/348,982

(22) Filed: Jan. 23, 2003

(65) Prior Publication Data

US 2003/0142988 A1 Jul. 31, 2003

(30) Foreign Application Priority Data

Jan. 31, 2002 (JP) ..... 2002-024832
Dec. 3, 2002 (JP) ..... 2002-351217

(51) Int. Cl.[7] ..... G03G 15/00; G03G 15/01

(52) U.S. Cl. ..... 399/49; 347/116; 399/301; 399/302

(58) Field of Search ..... 399/49, 66, 72, 399/101, 149, 150, 299, 301–303; 347/116

(56) References Cited

U.S. PATENT DOCUMENTS 6,249,656 B1 * 6/2001 Watanabe et al. ..... 399/66
6,693,654 B2 * 2/2004 Shinohara ..... 347/116

FOREIGN PATENT DOCUMENTS

JP 2001-324855 11/2001

* cited by examiner

*Primary Examiner*—William J. Royer
(74) *Attorney, Agent, or Firm*—Fitzpatrick, Cella, Harper & Scinto

(57) ABSTRACT

An image forming apparatus includes an electrostatic latent image forming unit for forming an electrostatic latent image on the surface of an image carrier, a developing unit for developing the electrostatic latent image with toner, a transferring unit for transferring a toner image on the image carrier onto a transfer medium in a transfer area, a test pattern forming unit for forming a test pattern, which is made of toner and used for image control, on the transfer medium, and a control unit for detecting the test pattern and executing image control. The transferring unit transfers the test pattern on the transfer medium, which has been subjected to detection, onto the image carrier, and the developing unit recovers the test pattern having been transferred onto the image carrier.

24 Claims, 13 Drawing Sheets

IMAGE FORMING APPARATUS WITH TEST PATTERN FOR IMAGE CONTROL

BACKGROUND OF THE INVENTION

1. Field of the Invention

The present invention relates to an image forming apparatus, such as a copying machine, a facsimile machine and a printer, for forming an image on a recording material to obtain a hard copy based on an electrophotographic process.

2. Description of the Related Art

In many conventional image forming apparatuses utilizing the electrophotographic process, a corona charger has been employed as means for electrically charging a drum type electrophotographic photoconductor (hereinafter referred to as a "photoconductor") that serves as an image carrier. The corona charger is arranged in a non-contact and opposed relation to the photoconductor and the photoconductor surface is exposed to discharge corona generated by the corona charger so that the photoconductor surface is electrically charged to a predetermined potential with a predetermined polarity.

On the other hand, a contact charger (direct charger) has recently been put into practical use because of superior advantages over the corona charger, i.e., less ozone and lower power consumption. With a contact charger, a charging member, to which a voltage is applied, is contacted with a photoconductor so that the photoconductor surface is electrically charged to a predetermined potential with a predetermined polarity. A contact charger using a magnetic brush, as the charging member, is employed in many cases because of advantages such as a good charging ability and safety in contact. In a magnetic brush type contact charger, conductive magnetic particles are magnetically retained on a magnet directly or on a sleeve incorporating a magnet to serve as a magnetic brush. The magnetic brush is contacted with the photoconductor surface while the photoconductor is stopped or rotated. By applying a voltage to the magnetic brush in such a condition, charging of the photoconductor is started. Alternatively, a brush made up of conductive fibers (fur brush) or a conductive rubber roll fabricated by forming conductive rubber into a roll shape can also be used as the contact charging member.

As another type of contact charging, an injection charging method is also known in which a charge injection layer is provided in a photoconductor and a charging member, to which a voltage is applied, is contacted with the photoconductor to inject charges into the charge injection layer so that the photoconductor surface is electrically charged to a predetermined potential with a predetermined polarity. With this injection charging method, the photoconductor can be charged to have a surface potential substantially identical to an applied DC voltage (DC bias) regardless of whether or not an AC voltage (AC bias) is applied to the charging member in a superimposed manner. Thus, since the photoconductor is electrically charged without utilizing a discharge phenomenon that occurs in the case of employing the corona charger, the charging can be realized with generation of no ozone and lower power consumption.

Furthermore, in recent years, a so-called cleaner-less system has also been put into practical use for the purposes of reducing the apparatus size, simplifying the construction, and not producing waste toner from the viewpoint of environmental friendliness. In the cleaner-less system, a cleaning device for removing toner from the photoconductor surface remaining after transfer of a toner image onto a recording (transfer) material, e.g., a sheet of paper, is omitted. After recovering the toner remaining after the transfer by a contact charging device, the toner is ejected from the contact charging device to be recovered by a developing device during a period in which an image is not formed.

By employing the cleaner-less system and the injection charging method, a smaller and simpler image forming apparatus generating no ozone, consuming lower power and recovering the leftover toner can be obtained.

FIG. 12 is a schematic view of a laser beam printer as a conventional image forming apparatus. The laser beam printer comprises a photoconductor 1 serving as an image carrier, a magnetic brush 3 serving as a contact charging means, an exposure device 100, a developing device 4, and a transfer device 7 serving as transfer means. The components 3, 100, 4, and 7 are successively disposed around the photoconductor 1 in the rotating direction (denoted by arrow A) thereof.

In an image forming mode, the photoconductor 1 is driven by a driving means (not shown) to rotate in the direction of arrow A. During the rotation, the photoconductor surface is uniformly electrically charged (with a negative polarity) by the magnetic brush 3 serving as a contact charging means. Then, the uniformly charged surface of the photoconductor 1 is subjected to exposure of an image by the exposure device (laser scanning device) 100 using a laser beam, whereby an electrostatic latent image corresponding to image information is formed on the photoconductor 1. The electrostatic latent image is developed into a toner image through a reversal process by the developing device 4.

When the toner image on the photoconductor 1 reaches a transfer nip 70 between the photoconductor surface and a transfer belt 71 of the transfer device 7, a recording material P in a cassette 41 is supplied by a sheet supply roller 42 and then fed to the transfer nip 70 by a register roller 43 in a timed relation. Then, charges having a polarity opposite to that of the toner are applied to the backside of the recording material P from a transfer charging blade 74, to which a transfer bias is applied, whereby the toner image on the photoconductor 1 is transferred onto the front side of the recording material P. The recording material P having the transferred toner image is separated from the surface of the transfer belt 71 with the aid of a separation charger 15, and then fed to a fusing device 6. The toner image is fused into a permanently fixed image on the surface of the recording material P by the fusing device 6, and thereafter the recording material P is ejected from the image forming apparatus.

On the photoconductor 1 having passed the transfer nip 70, there exists, though in a small amount, toner that has not been transferred onto the recording material P at the transfer nip 70 (i.e., after-transfer remaining toner). The after-transfer remaining toner is electrostatically and physically scraped off by the magnetic brush 3 and is temporarily absorbed by the magnetic brush 3. As the after-transfer remaining toner accumulates inside the magnetic brush 3, the resistance of the magnetic brush 3 itself is increased to such an extent that the magnetic brush 3 can no longer sufficiently charge the photoconductor 1. This produces a potential difference between the magnetic brush 3 and the surface of the photoconductor 1, whereupon the after-transfer remaining toner so far retained by the magnetic brush 3 is caused to electrostatically move onto the photoconductor 1. The after-transfer remaining toner having moved onto the photoconductor 1 is electrostatically taken in by the developing device 4 and then consumed in a next cycle of image formation.

On the other hand, toner remaining on the surface of the transfer belt 71, from which the recording material P has been peeled off, is removed by a transfer belt cleaner 92 constituted by a urethane rubber blade to be ready for a next cycle of image formation.

FIG. 13 is a schematic view of a color laser beam printer as a conventional 4-drum full-color image forming apparatus. In this color laser beam printer, rotary drum type photoconductors 1*a* to 1*d* serving as image carriers are provided in respective image forming stations. Magnetic brushes 3*a* to 3*d* serving as contact charging means, exposure devices 100*a* to 100*d*, developing devices 4*a* to 4*d*, and transfer devices 7 (transfer charging blades 74*a* to 74*d*) are disposed respectively around the photoconductors 1*a* to 1*d*.

In an image forming mode, the photoconductors 1*a* to 1*d* are driven to rotate about respective central support shafts at a predetermined circumferential speed (process speed). During the rotation, the photoconductor surfaces are uniformly electrically charged with a negative polarity by the magnetic brushes 3*a* to 3*d* serving as contact charging means.

Then, the uniformly charged surfaces of the photoconductors 1*a* to 1*d* are subjected to scan exposure of laser beams modulated corresponding to image signals of respective colors (yellow, magenta, cyan and black) output from the exposure devices (laser scanning devices) 100*a* to 100*d*, whereby electrostatic latent images corresponding to image information of the respective colors are successively formed on the photoconductors 1*a* to 1*d*. The electrostatic latent images formed on the photoconductors 1*a* to 1*d* are developed by the respective developing devices 4*a* to 4*d*. More specifically, a yellow toner image is developed by the developing device 4*a*, a magenta toner image is developed by the developing device 4*b*, a cyan toner image is developed by the developing device 4*c*, and a black toner image is developed by the developing device 4*d* in succession.

On the other hand, recording materials P, e.g., sheets of paper, stocked in a sheet supply cassette 41 are supplied one by one by a sheet supply roller 42 and then fed by a register roller 43 at predetermined timing to a transfer nip between the photoconductor 1*a* and the transfer device 7, serving as transfer means. Then, the toner image on each photoconductor 1*a* to 1*d* is transferred onto the recording material P in succession.

Finally, the recording material P having the transferred toner images is separated from the surface of a transfer belt 71 with the aid of a separation charger 15, and then passes a fusing device 6 in which the toner is fused and fixed under heat and pressure. Thereafter, the recording material P having a permanently fixed image is ejected from the image forming apparatus.

Detection and control of toner density will be described below.

Toner density is conventionally detected, for example, by an optical or magnetic detection method utilizing the fact that the light reflectance or the magnetic permeability of a developer, i.e., a mixture of toner and carriers, is changed depending on the toner density. However, the optical detection method has the problem that a transparent window for viewing the developer is stained with the toner itself. The magnetic detection method has the problem that the bulk density of the developer is changed depending on the temperature and the humidity, and therefore errors are caused in the magnetic permeability. Further, for the purpose of feedback in control of the finally required image density, a deterioration in charging power of the photoconductor 1*a* to 1*d* and the charging means 3*a* to 3*d* must also be taken into consideration. Thus, it is desired to measure the image density after transfer, which is closer to the final image density based on the toner density and the charging power, and to feed back the measured result to the density control.

In view of the above, one conventional method of detecting the toner density comprises the steps of forming an image-density measuring test pattern on the photoconductor 1*a* to 1*d* at a position outside the area of an image transferred onto the recording material P, transferring the test pattern onto the transfer belt 71 at a position outside the image area to obtain an image density closer to the final image density, and detecting the intensity of light reflected from a toner image of the test pattern.

Further, in addition to the density control, for registering position shifts of images among a plurality of image carriers, there has also been employed a method of forming a position-shift detecting test pattern on the transfer belt 71, reading the test pattern to detect the position shift, and feeding back the detected result in position shift control.

Such a test pattern in the form of a toner image, which has been formed on the transfer belt 71 and from which the image density has been read, is likewise removed by the transfer belt cleaner 92.

In the above-described image forming apparatuses each utilizing the cleaner-less system, the after-transfer remaining toner on the photoconductor 1*a* to 1*d* is reused and hence a great improvement of toner utilization factor is expected. However, since the test pattern in the form of a toner image is formed for feedback control of, e.g., the toner density for stabilizing the density of an output image, leftover toner is generated, though in a small amount. Also, for treating the leftover toner, the transfer belt cleaner 92 and a recovery container for the leftover toner recovered from the transfer belt cleaner 92 are required.

Moreover, when the transfer belt cleaner 92 and the recovery container are located far away from each other from limitations in layout of the internal structure of an apparatus body, a leftover toner transport passage, and the like are required. Additionally, the generation of leftover toner is disadvantageous in that users are required to exchange the recovery container and the amount of consumed toner is increased.

SUMMARY OF THE INVENTION

With the view of solving the problems set forth above, it is an object of the present invention to provide an image forming apparatus which can improve the toner utilization factor.

To achieve the above object, an image forming apparatus according to one aspect of the present invention includes an electrostatic latent image forming unit for forming an electrostatic latent image on a surface of an image carrier, a developing unit for developing the electrostatic latent image with toner, a transferring unit for transferring a toner image on the image carrier onto a transfer medium in a transfer area, a test pattern forming unit for forming a test pattern, which is made of toner and used for image control, on the transfer medium, and a control unit for detecting the test pattern and executing image control. The transferring unit transfers the test pattern on the transfer medium, which has been subjected to detection, onto the image carrier, and the developing unit recovers the test pattern having been transferred onto the image carrier.

Also, an image forming apparatus according to another aspect of the present invention includes a plurality of electrostatic latent image forming units for forming electrostatic latent images on surfaces of a plurality of image carriers, a plurality of developing units for developing the electrostatic latent images on the plurality of image carriers with toners of different colors, a plurality of transferring units for transferring toner images on the plurality of image carriers onto a transfer medium in respective transfer areas, test pattern forming units for forming test patterns, which are made of toners of different colors and used for image control, on the transfer medium, and a control unit for detecting the test patterns and executing image control. The plurality of transferring units transfer the test patterns on the transfer medium, which have been subjected to detection, onto the image carriers corresponding to respective colors of the toners forming the test patterns, and the developing units associated with the image carriers, onto which the test patterns have been transferred, recover the corresponding test patterns.

Further objects, features and advantages of the present invention will become apparent from the following description of the preferred embodiments with reference to the attached drawings.

DESCRIPTION OF THE PREFERRED EMBODIMENTS

Preferred embodiments of the present invention will be described below with reference to the drawings.

First Embodiment

Figure 1:
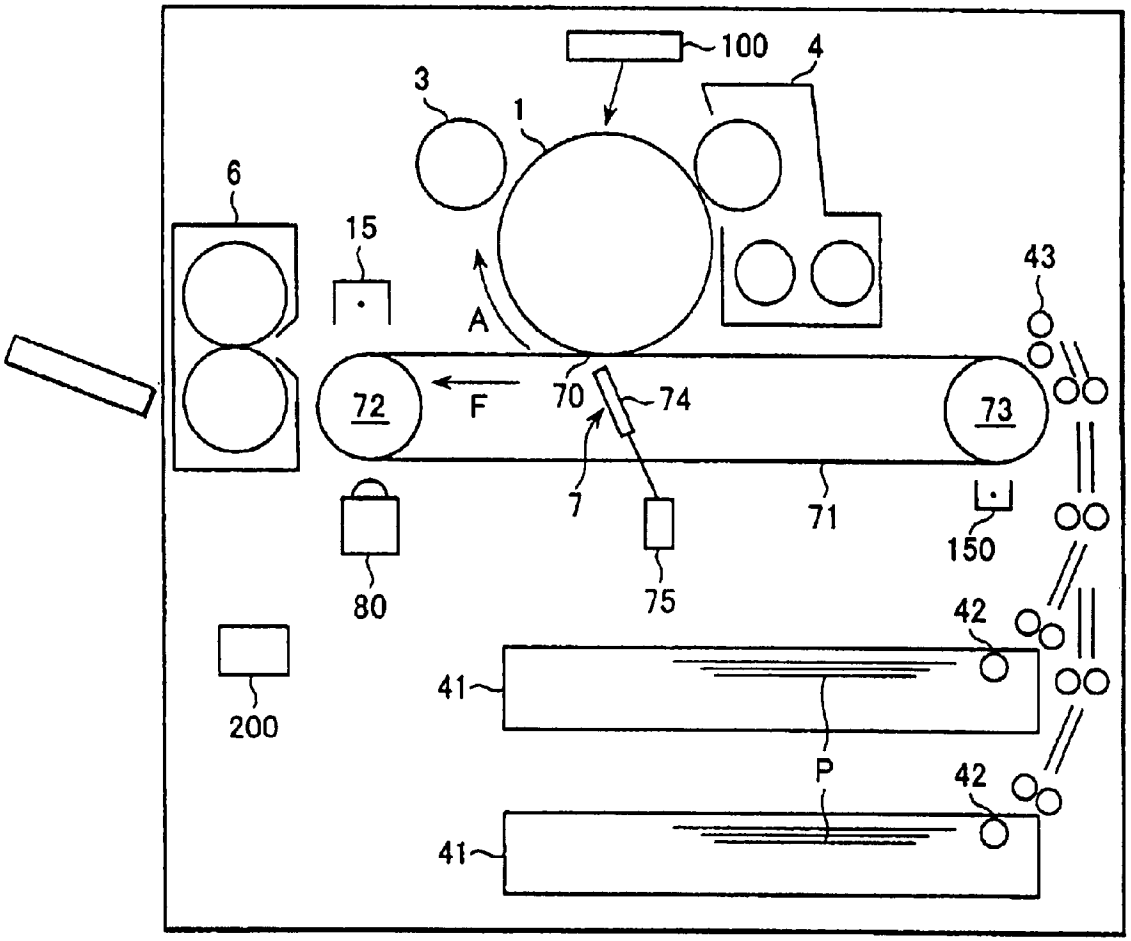
FIG. 1 is a schematic view showing an embodiment in which an image forming apparatus according to the present invention is applied to a laser beam printer utilizing the electrophotographic process.

FIG. 1 is a schematic view showing an image forming apparatus according to a first embodiment. This image forming apparatus represents a laser beam printer utilizing the electrophotographic process, which is constituted as a cleaner-less system and in which a contact charger in the form of a magnetic brush is employed as a charging means for an image carrier.

As with the related art described above, a rotary drum type photoconductor 1 serving as an image carrier is driven to rotate about a central support shaft at a predetermined circumferential speed (process speed). During the rotation, the photoconductor surface is uniformly electrically charged with a negative polarity by a magnetic brush 3 serving as contact charging means. Then, the uniformly charged surface of the photoconductor 1 is subjected to scan exposure of a laser beam modulated corresponding to an image signal output from an exposure device (laser scanning device) 100, whereby an electrostatic latent image corresponding to image information is formed on the photoconductor 1. The electrostatic latent image formed on the photoconductor 1 is developed into a toner image through a reversal process by a developing device 4.

On the other hand, recording (transfer) materials P, e.g., sheets of paper, stocked in a sheet supply cassette 41 are supplied one by one by a sheet supply roller 42 and then fed to a transfer nip 70 between the photoconductor 1 and a transfer device 7 by a register roller 43 at predetermined timing. Then, a predetermined transfer bias (having a polarity opposite to that of toner charges) is applied to a transfer charging blade 74 from a transfer-bias applying power supply 75. As a result, charges having a polarity opposite to that of the toner are applied to the backside of the recording material P and the toner image on the photoconductor 1 is transferred onto the recording material P.

Finally, the recording material P having the transferred toner image is separated from the surface of a transfer belt 71 with the aid of a separation charger 15, and then fed to a fusing device 6. While passing the fusing device 6, the toner is fused and fixed under heat and pressure. Thereafter, the recording material P having a permanently fixed image is ejected from the image forming apparatus.

Control of the operation of the above-described apparatus is performed by a control unit 200.

The photoconductor 1 can be constituted by an organic photoconductor or the like that has been conventionally employed. However, it is preferable to use a photoconductor having a surface layer, which is made of a material with resistance in the range of $10^9$ to $10^{14}$ Ω·cm, formed on the surface of an organic photoconductor, or an amorphous silicon photoconductor because of the advantages that charge injection can be realized, generation of ozone is avoided, and power consumption is reduced. In addition, charging efficiency can also be improved.

Figure 2:
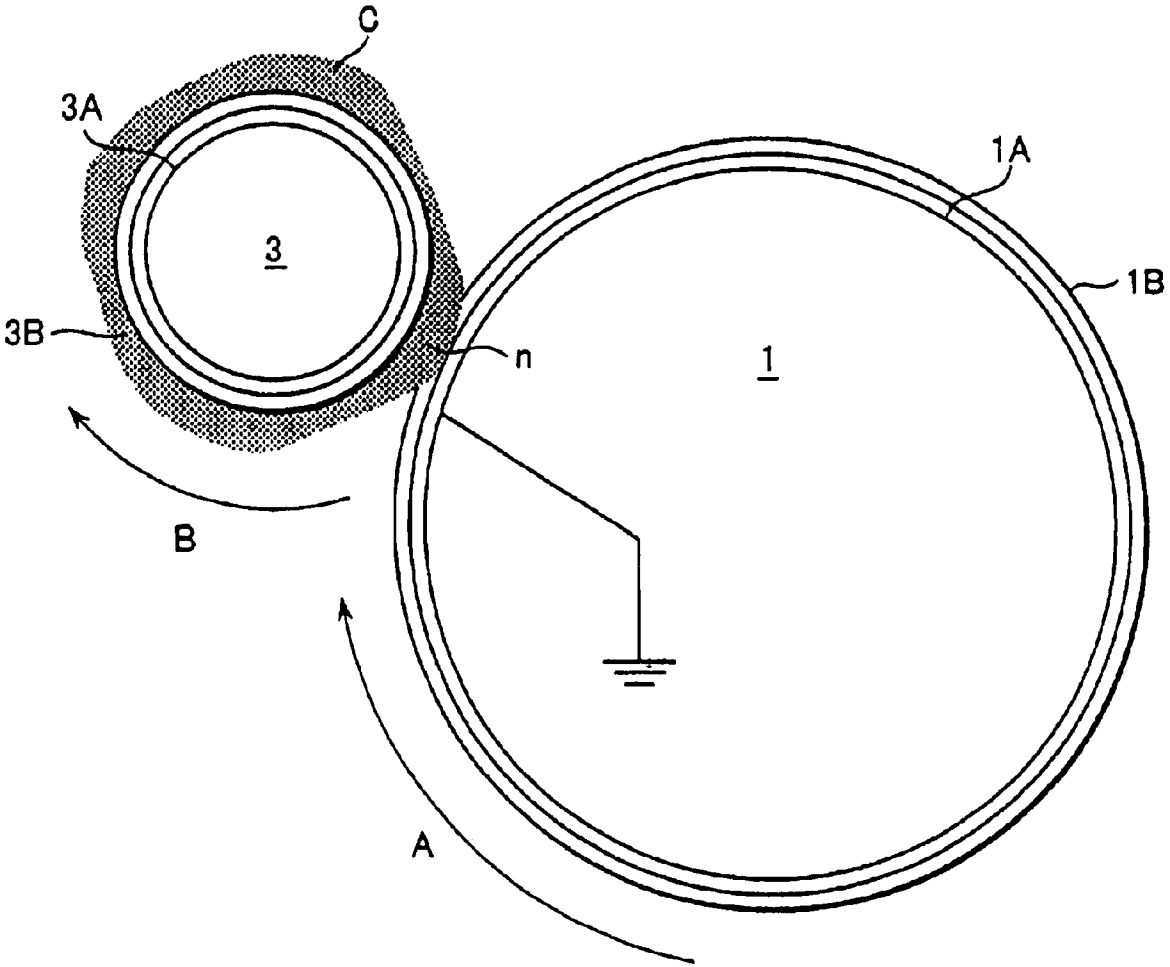
FIG. 2 is a schematic view showing the positional relationship between a magnetic brush and a photoconductor in the image forming apparatus.

As shown in FIG. 2, the photoconductor 1 is an organic photoconductor electrically charged with a negative polarity, and comprises an aluminum-made drum base 1A with a diameter of 30 mm and a photoconductor layer 1B made up of five layers (first to fifth) formed on the drum base 1A from the inner side in order. The photoconductor 1 is driven to rotate at a predetermined process speed (e.g., 100 mm/sec).

The first layer formed on the lowermost side of the photoconductor layer 1B is an undercoat layer that is formed as a conductive layer with a thickness of 20 μm to eliminate defects and the like of the drum base 1A for surface evenness. The second layer is a positive-charge injection preventing layer that serves to prevent positive charges injected from the drum base 1A from canceling out negative charges electrically charged on the surface of the photoconductor 1. To that end, the second layer is formed as a medium resistance layer with a thickness of 1 μm, which is made up of Amilan resin and methoxy-methylated nylon and has resistance adjusted to be about $10^6$ Ω·cm. The third layer is a charge generating layer with a thickness of about 0.3 μm, which is formed by dispersing a diazo-based pigment in a resin. The third layer generates pairs of positive and negative charges upon exposure of a laser beam. The fourth layer is a charge transport layer that is formed as a P-type semiconductor by dispersing hydrazine in a polycarbonate resin. Accordingly, negative charges electrically charged on the surface of the photoconductor 1 cannot move through the fourth layer, and only positive charges generated in the third layer (charge generating layer) can be transported to the surface of the photoconductor 1.

The fifth layer formed at an outermost surface of the photoconductor 1 is a charge injection layer, i.e., a coating layer of a material that is prepared by dispersing, as conductive micro particles, super-micro particles of $SnO_2$ in a binder made of an insulating resin. More specifically, a coating liquid as a material of the coating layer is prepared by dispersing, in an insulating resin, 70 weight % of super-micro particles of $SnO_2$ that have a particle size of about 0.3 μm and have resistance reduced (i.e., made conductive) by doping antimony as light-transmitting conductive fillers. The coating liquid thus prepared is coated in thickness of about 3 μm to form the charge injection layer by an appropriate coating method, such as dipping, spraying, roll coating, or beam coating.

The contact charging means is constituted as a magnetic brush type charging device (hereinafter referred to as a "magnetic brush") 3. The magnetic brush 3 is of the sleeve rotary type comprising a fixed magnet roller 3A with a diameter of 16 mm; a non-magnetic SUS sleeve 3B rotatably fitted over the magnet roller 3A, and a magnetic brush layer C of magnetic particles (magnetic carriers) attracted to and held on an outer circumferential surface of the sleeve 3B by magnetic forces exerted from the magnet roller 3A.

The magnetic particles constituting the magnetic brush layer C preferably have an average particle size of 10 to 100 μm, saturation magnetization of 20 to 250 emu/$cm^3$, and resistance of $1\times10^2$ Ω·cm to $1\times10^{10}$ Ω·cm. Further, considering the fact that insulation defects, such as pinholes, are present on the photoconductor 1, it is more preferable that the resistance of the magnetic particles be not lower than $1\times10^6$ Ω·cm. Incidentally, a resistance value of the magnetic particles was measured by putting 2 g of the magnetic particles in a metallic cell with a bottom area of 228 $cm^2$, weighing a load of 6.6 kgf/$cm^2$ to press the magnetic particles, and applying a voltage of 100 V.

Also, to improve the charging performance of the magnetic brush 3, the resistance of the magnetic brush 3 should be as small as possible. In this embodiment, therefore, the magnetic brush 3 was formed by employing the magnetic particles with an average particle size of 25 μm, saturation magnetization of 200 emu/$cm^3$, and resistance of $5\times10^6$ Ω·cm, and then magnetically attracting 40 g of those magnetic particles to the outer circumferential surface of the sleeve 3B. The magnetic particles are prepared as resin carriers formed by dispersing a magnet, as a magnetic material, in a resin and further dispersing carbon black in it for electrical conduction and resistance adjustment, or prepared by coating the surface of magnetite alone, such as ferrite, with a resin for resistance adjustment.

The magnetic brush 3 is disposed such that the magnetic brush layer C is in contact with the surface of the photoconductor 1. A contact nip (charging nip) n between an inner circumference of the magnetic brush layer C and the photoconductor 1 has a width of 6 mm. Then, a predetermined charging bias voltage is applied to the sleeve 3B from a power supply (not shown), and the sleeve 3B is driven to rotate in the direction of arrow B counter (opposite) to the rotating direction A of the photoconductor 1 in the contact nip n between the inner circumference of the magnetic brush layer C and the photoconductor 1 at a circumferential speed of, e.g., 150 mm/sec in comparison with the circumferential speed of 100 mm/sec of the photoconductor 1. Thus, the surface of the photoconductor layer 1B of the photoconductor 1 is wiped by the magnetic brush layer C, to which the charging bias is applied, so that the surface of the photoconductor 1 is subjected to a primary charging process, i.e., it is uniformly charged to a desired potential by an injection charging method. In addition, by increasing the rotational speed of the sleeve 3B, a contact area of the magnetic brush 3 with after-transfer remaining toner on the photoconductor 1 is increased and hence the after-transfer remaining toner is recovered to the magnetic brush 3 with higher efficiency.

Figure 3:
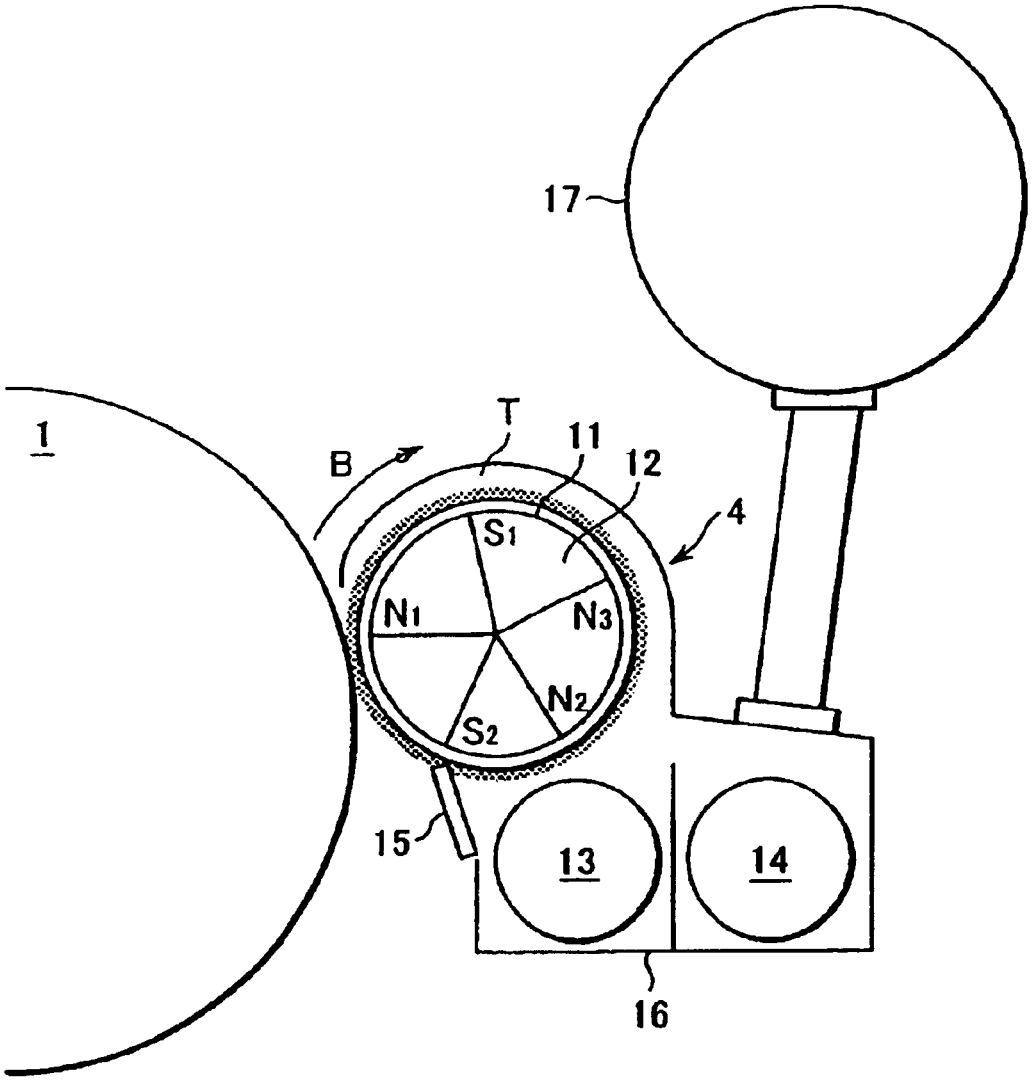
FIG. 3 is a schematic view showing a construction of a developing device in the image forming apparatus.

FIG. 3 is a schematic view showing a construction of the developing device 4 constituted as a 2-component contact developing device (2-component magnetic brush developing device). Referring to FIG. 3, the developing device 4 comprises a developing sleeve 11 driven to rotate in the direction of arrow B, a magnet roller 12 fixedly disposed inside the developing sleeve 11, mixing screws 13 and 14, a restricting blade 15 arranged so as to form a thin layer of a developer T on the surface of the developing sleeve 11, and a developing container 16. Additionally, a toner replenishing device 17 containing toner to be replenished is disposed above the developing container 16.

The developing sleeve 11 is arranged and set such that, at least during the development, a distance of about 500 μm is left between the photoconductor 1 and a sleeve area closest to it, and the development can be performed in a condition in which the thin layer of the developer T formed on the surface of the developing sleeve 11 contacts the photoconductor 1. The developer T is a powder mixture of toner and carriers. The toner is prepared by adding 1 weight % of titanium oxide having an average particle size of 20 nm to negatively charged toner that is manufactured by a pulverizing method and has an average particle size of 6 μm. The carriers are magnetic carriers having saturation magnetization of 205 emu/$cm^3$ and an average particle size of 35 μm. This embodiment employs 200 g of the developer T prepared by mixing the toner and the carriers at a weight ratio of 6:94. With continued formation of an image, the toner density (or concentration) of 6% in the developer T is reduced because only the toner is consumed. However, the toner density of an image is always detected and controlled in toner density control. If there occurs a deficiency in the toner density, the toner is replenished from the toner replenishing device 17 in an amount corresponding to the deficiency so that the developer T always maintains the toner density of 6%. A toner density detecting means will be described later.

A description is now made of a developing process in which the electrostatic latent image on the surface of the photoconductor 1 is visualized by the developing device 4 based on the 2-component magnetic brush method, and a system for circulating the developer T.

First, With the rotation of the developing sleeve 11, the developer T is drawn up from the developing container 16 as the developing sleeve 11 is moved from a pole N2 to S2. Then, during transport along the pole S2, the attracted developer T is restricted by the restricting blade 15 that is substantially vertically arranged relative to the developing sleeve 11, and a thin layer of the developer T is formed on the developing sleeve 11. When the thin layer of the developer T is transported to a pole N1, the developer T is brought into the form of a spike (magnetic brush) under the action of magnetic forces. The electrostatic latent image is developed by the developer T in the form of a spike. Thereafter, the developer T on the developing sleeve 11 is returned to the developing container 16 under the action of repulsive magnetic fields exerted from poles N3 and N2.

A DC voltage and an AC voltage are applied to the developing sleeve 11 from a power supply (not shown). In this embodiment, a DC voltage of—500 V and an AC voltage of 1500 V with a frequency of 2000 Hz are applied.

Generally, the 2-component developing method has a tendency that, with application of an AC voltage, the development efficiency is increased and image quality is improved, but fogging is more apt to occur. Therefore, fogging is conventionally prevented by providing a potential difference between the DC potential applied to the developing device 4 and the surface potential of the photoconductor 1.

As shown in FIG. 1, a belt transfer device is used as the transfer device 7. An endless transfer belt 71 serving as a transfer medium is stretched between a drive roller 72 and a driven roller 73, and is driven to rotate substantially at the same circumferential speed as that of the photoconductor 1 in the direction of arrow F. An upper run portion of the transfer belt 71 is contacted with the surface of the photoconductor 1, and the recording material P is fed to the transfer nip (transfer area) 70 while it rests on the surface of the upper run portion of the transfer belt 71. When a predetermined transfer bias (having a polarity opposite to that of toner charges) is applied to the transfer charging blade 74 from the transfer-bias applying power supply 75, charges having a polarity opposite to that of the toner are applied to the backside of the recording material P and the toner image on the photoconductor 1 is successively transferred onto an upper surface of the recording material P.

In this embodiment, the transfer belt 71 is formed of a polyfluoride vinylidene resin having a thickness of 100 $\mu$m and has been subjected to whitening treatment. The material of the transfer belt 71 is not limited to the polyfluoride vinylidene resin, and other materials can also be suitably employed, including plastics such as a polycarbonate resin, a polyethylene terephthalate resin, a polyimide resin, a polyethylene naphthalate resin, a polyether ether ketone resin, a polyether sulfone resin, and a polyurethane resin, as well as fluorine- and silicon-based rubber. Also, the thickness of the transfer belt 71 is not limited to 100 $\mu$m. For example, the transfer belt 71 having a thickness in the range of 25 to 2000 $\mu$m, preferably in the range of 50 to 150 $\mu$m, is also suitably employed. Further, the transfer charging blade 74 employed in this embodiment has resistance of $1\times10^5$ to $1\times10^7$ Ω, a plate thickness of 2 mm, and a length of 306 mm. In addition, transfer is performed by applying a bias of 10 $\mu$A to the transfer charging blade 74 from the transfer-bias applying power supply 75 under constant-current control.

In that way, the toner image formed on the surface of the photoconductor 1 is transferred onto the recording material P by the transfer charging blade 74. The transfer belt 71 serves also as means for feeding the recording material P to the fusing device 6, and the recording material departing from the surface of the photoconductor 1 is fed to the fusing device 6 by the transfer belt 71.

The after-transfer remaining toner left on the surface of the photoconductor 1 after the transfer is electrosatically and physically scraped off by the magnetic brush layer C of the magnetic brush 3 and then temporarily absorbed by the magnetic brush layer C. As the after-transfer remaining toner accumulates inside the magnetic brush layer C, the resistance of the magnetic brush layer C is increased to such an extent that the magnetic brush layer C can no longer sufficiently charge the photoconductor 1. This produces a potential difference between the magnetic brush layer C and the surface of the photoconductor 1, whereupon the after-transfer remaining toner so far retained by the magnetic brush layer C is caused to electrostatically move onto the photoconductor 1. The after-transfer remaining toner having moved onto the photoconductor 1 is electrostatically taken in by the developing device 4 and then consumed in a next cycle of image formation.

In this embodiment, the toner density detecting means is realized by forming an image-density measuring test pattern on the photoconductor 1 at a position outside the area of an image transferred onto the recording material P, and transferring the test pattern onto the transfer belt 71 at a position outside the image area.

Thus, an image density closer to the final image density is obtained, and the toner density is detected by measuring the intensity of light reflected from a toner image of the test pattern. The test pattern used for detecting the toner density is formed as a check pattern with a coverage of 50% so that a good contrast is achieved with respect to the white transfer belt 71. The test pattern has a size of 30 mm in the running direction of the transfer belt 71.

Figure 4:
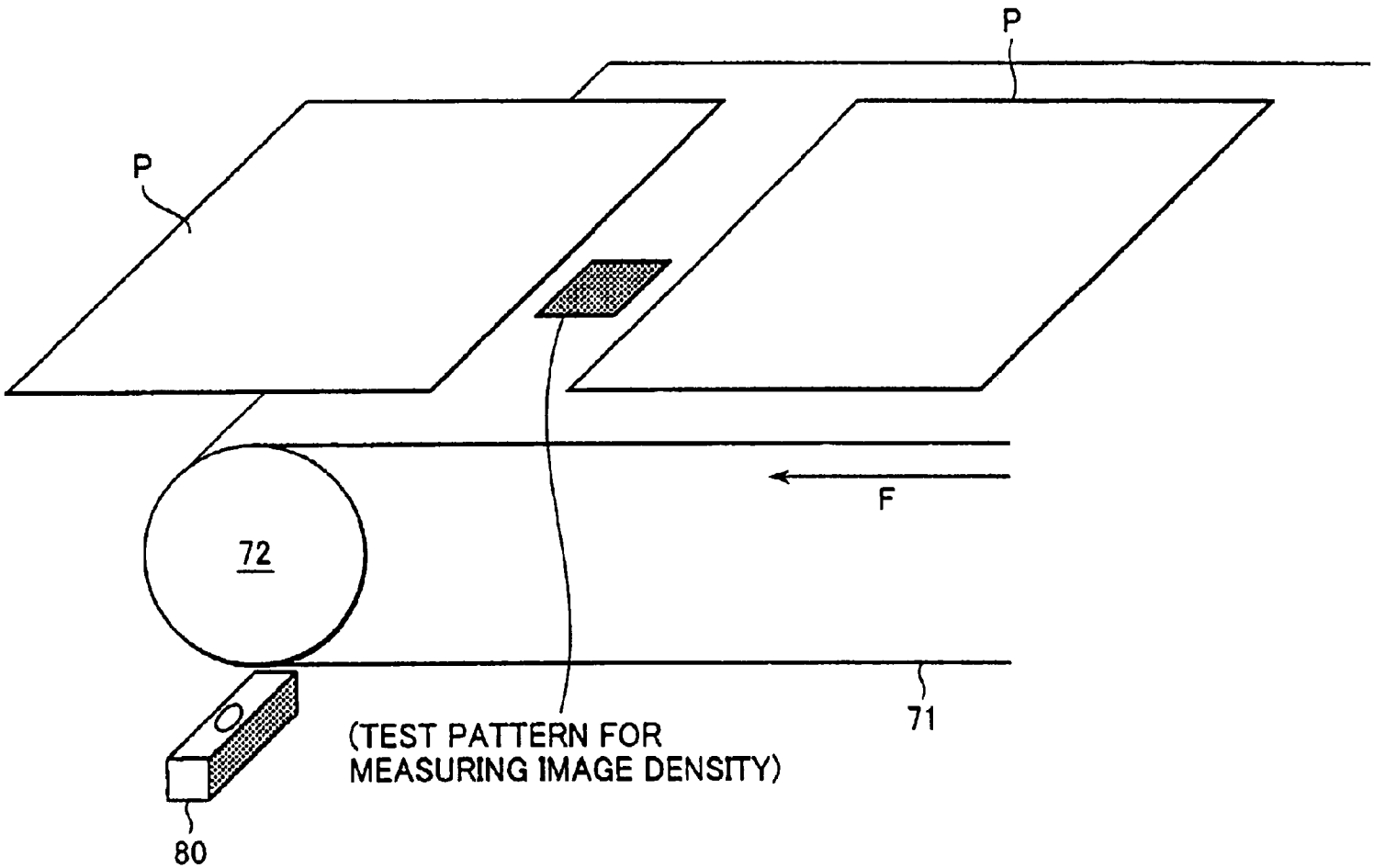
FIG. 4 is a schematic view showing a test pattern for measuring the density of an image transferred onto a transfer belt.

As shown in FIG. 4, the image-density measuring test pattern is formed at a frequency of once per 10 output images so that the test pattern is produced in an interval between normal image forming processes without reducing the specific throughput of the image forming apparatus and stability of the image density is ensured. As a sensor for reading the image density, a light-reflecting density sensor 80 is disposed below the drive roller 72. In this embodiment, the toner is replenished to the developing device 4 depending on an output of the light-reflecting density sensor 80. As a result, the ratio of toner to carriers in the developing device 4 is held constant and the image density is stabilized.

The test pattern, from which the image density has been read, passes on the lower run side of the transfer belt 71 and is fed to the transfer area 70 again. In the normal image forming process (in which the toner image is transferred onto the recording material P), a positive bias having a polarity opposite to that of the charges of the toner image is applied by the transfer charging blade 74 from the backside of the transfer belt 71, causing the toner image having the negative charge polarity to be transferred onto the recording material P. However, at the time when the test pattern passes the transfer nip 70 again, a negative bias having the same polarity as that of the charges of the toner image is applied by the transfer-bias applying power supply 75 via the transfer charging blade 74 from the backside of the transfer belt 71, causing the toner image having the negative charge polarity to be inversely transferred onto the surface of the photoconductor 1.

The toner forming the inversely transferred test pattern image is reused by the magnetic brush 3 and the 2-component developing device 4 as described above.

During the continuous image formation, the test pattern passes on the upper run side of the transfer belt 71. Due consideration is required to avoid the test pattern from overlapping with the recording material P.

As a modification, the toner image of the test pattern can also be inversely transferred from the transfer belt 71 onto the surface of the photoconductor 1, as shown in FIG. 1, by providing a toner polarity reversing unit 150 to reverse the polarity of the charges holding the toner image of the test pattern on the transfer belt 71. More specifically, the polarity of the charges holding the toner image of the test pattern is reversed to be positive by the toner polarity reversing unit 150 before the test pattern passes the transfer nip 70 again. Then, at the time when the test pattern passes the transfer nip 70, a positive bias is applied by the transfer charging blade 74 from the backside of the transfer belt 71, whereby the toner image of the test pattern can be inversely transferred from the transfer belt 71 onto the surface of the photoconductor 1. In this case, the control for reversing the polarity of the transfer charging blade 74 by the transfer-bias applying power supply 75 is no longer required.

The toner polarity reversing unit 150 may be, e.g., a corona charger, but it is not limited to a particular one so long as the toner polarity can be changed.

Second Embodiment

This second embodiment differs from the first embodiment in a method of recovering the image-density measuring test pattern (toner image) formed on the transfer belt 71.

Figure 5A:
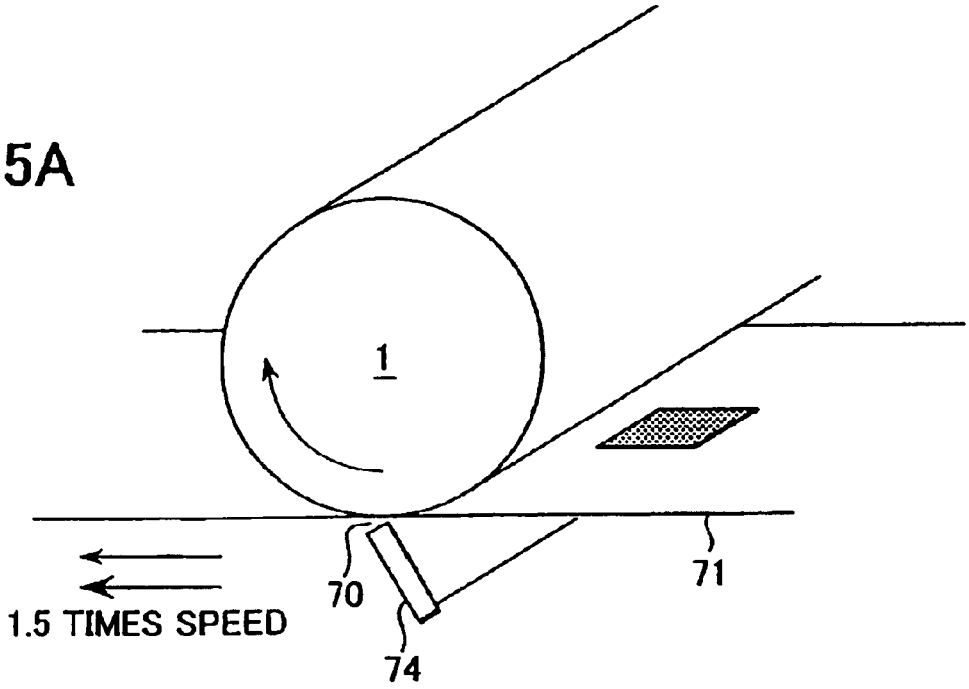
FIGS. 5A and 5B are schematic views showing an embodiment in which the feed speed of the transfer belt is increased.
Figure 5B:
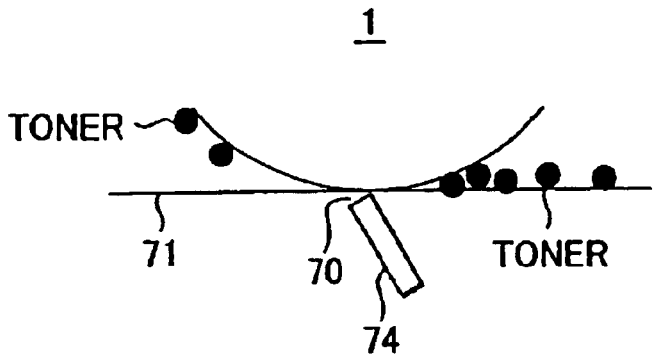

More specifically, FIGS. 5A and 5B show the second embodiment in which, at the time when a reversed bias is applied by the transfer charging blade 74, the feed speed of the transfer belt 71 is increased 1.5 times as high as the circumferential speed of the photoconductor 1 by controlling the rotational speed of the drive roller 72 with a speed control unit (not shown). During the normal image forming process, the moving speed of the transfer belt 71 is substantially the same as that of the photoconductor 1. On the other hand, at the time when the test pattern is transferred onto the photoconductor 1 upon application of the reversed bias, the moving speed of the transfer belt 71 is increased to be higher than that of the transfer belt 71 during the normal image forming process. With the speed of the transfer belt 71 made higher than that of the photoconductor 1, there occurs a sliding (wiping) action between the transfer belt 71 and the photoconductor 1, whereby the toner image on the transfer belt 71 is dammed by the surface of the photoconductor 1. Further, because electrostatic forces acting to attract the toner image toward the surface of the photoconductor 1 are superimposed, the toner image can be inversely transferred onto the surface of the photoconductor 1 with higher effectiveness.

Usually, however, the toner amount corresponds to the coverage of 50% and the concept of the first embodiment is enough to recover the toner image of the test pattern. In addition, because the concept of the second embodiment necessarily changes the feed speed of the recording material P as well, it is difficult to speed up the transfer belt 71 to match an interval between two adjacent recording materials (sheets) P during continuous image formation. Hence, the concept of the second embodiment is effectively employed, for example, when applied to the case of a sheet jam in which the recording material P is not normally fed for some reason.

A toner image may be formed on the transfer belt 71 accidentally other than intentionally like the case of forming the image-density measuring test pattern as described above. Stated otherwise, a toner image is formed on the transfer belt 71 when the recording material P is deformed or displaced, or when the recording material P is not supplied to the transfer nip 70 at the predetermined timing because of some failure caused in a sheet supply system. In such an event, a developed toner image is transferred onto the transfer belt 71, though in a small area, since the operation of the apparatus is not stopped at once. Since the amount of toner transferred in that event depends in terms of both the image density and the image area upon an input image to be formed, it may possibly be larger than that resulting from recovering the test pattern.

In that case, a restoration sequence is often automatically executed in the apparatus after an operator has taken an action to remove the sheet jam, for example. Thus, this second embodiment, i.e., the concept of providing a difference in circumferential speed between the photoconductor 1 and the transfer belt 71 is effectively applied to that case.

Third Embodiment

Figure 6:
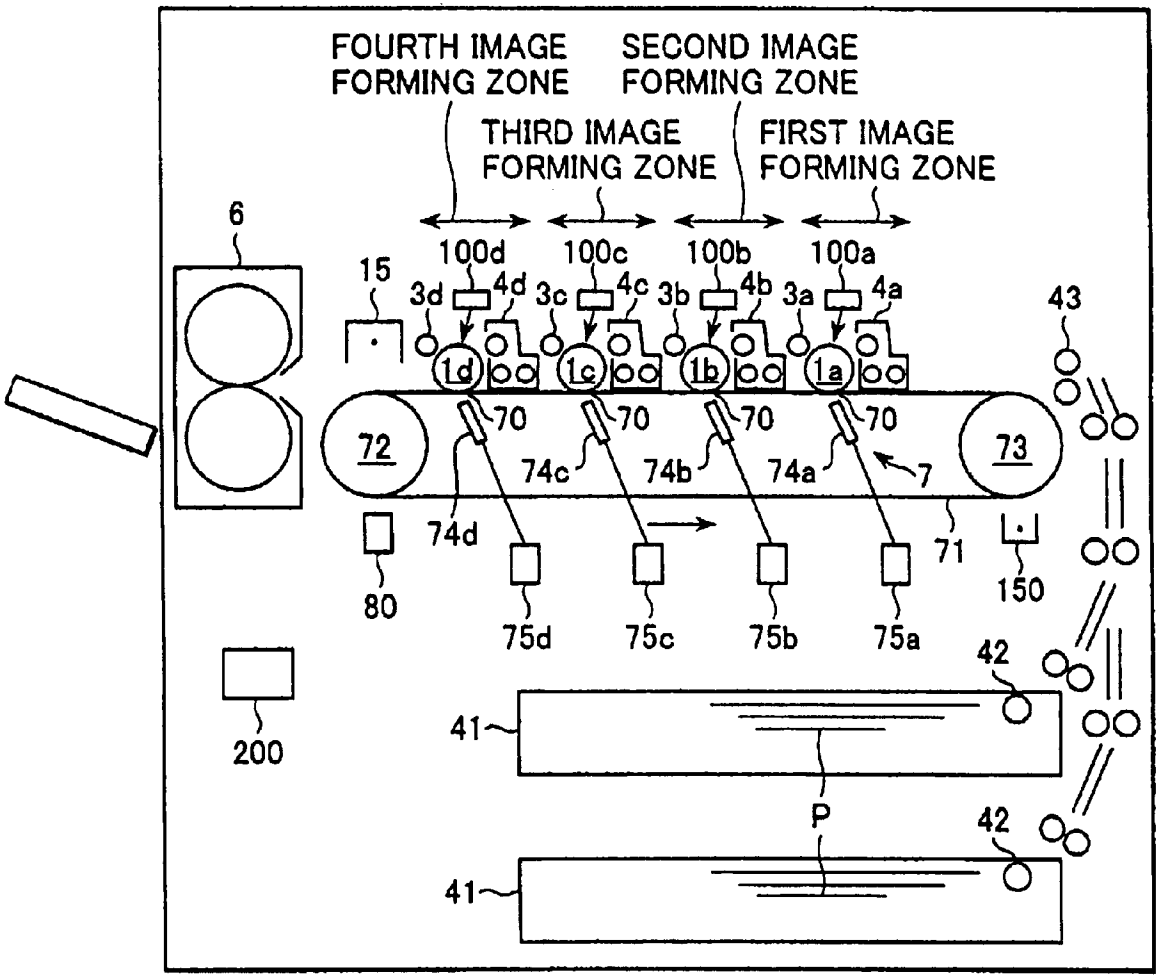
FIG. 6 is a schematic view showing an embodiment in which the image forming apparatus is applied to a color laser beam printer utilizing the electrophotographic process.

FIG. 6 is a schematic view showing, as a third embodiment of the image forming apparatus, a color laser beam printer utilizing the electrophotographic process. As with the first embodiment, the image forming apparatus is constituted as a cleaner-less system, and a contact charger in the form of a magnetic brush is employed as a charging means for an image carrier.

Similarly to the related art described above, rotary drum type photoconductors 1*a* to 1*d* serving as image carriers are driven to rotate about respective central support shafts at a predetermined circumferential speed (process speed). During the rotation, the photoconductor surfaces are uniformly electrically charged with a negative polarity by magnetic brushes 3*a* to 3*d* serving as contact charging means.

Then, the uniformly charged surfaces of the photoconductors 1*a* to 1*d* are subjected to scan exposure of laser beams modulated corresponding to image signals of respective colors output from exposure devices (laser scanning devices) 100*a* to 100*d*, whereby electrostatic latent images corresponding to image information of the respective colors are successively formed on the photoconductors 1*a* to 1*d*. The electrostatic latent images formed on the photoconductors 1*a* to 1*d* are developed through a reversal development process by respective developing devices 4*a* to 4*d*. More specifically, a yellow toner image is developed by the developing device 4*a*, a magenta toner image is developed by the developing device 4*b*, a cyan toner image is developed by the developing device 4C, and a black toner image is developed by the developing device 4*d* in succession.

On the other hand, recording materials P, e.g., sheets of paper, stocked in a sheet supply cassette 41 are supplied one by one by a sheet supply roller 42 and then fed to a transfer nip 70 between the photoconductor 1*a* and a transfer device 7 serving as transfer means by a register roller 43 at predetermined timing. Then, the toner image on each photoconductor 1*a* to 1*d* is transferred onto the recording material P in succession. Finally, the recording material P having the transferred toner images is fed to pass a fusing device 6 in which the toner is fused and fixed under heat and pressure. Thereafter, the recording material P having a permanently fixed image is ejected from the image forming apparatus.

Note that components (i.e., the photoconductors, magnetic brush type charging members, and developing devices) of each of first to fourth image forming zones are the same as those described above, and hence a description thereof is omitted here.

The transfer device 7 is constituted as a belt transfer device. An endless transfer belt 71 is stretched between a drive roller 72 and a driven roller 73, and is driven to rotate substantially at the same circumferential speed as that of the photoconductors 1*a* to 1*d* in the direction shown by the arrow. An upper run portion of the transfer belt 71 is contacted with the surfaces of the photoconductors 1*a* to 1*d*, and the recording material P is fed while it rests on the surface of the upper run portion of the transfer belt 71. When a predetermined transfer bias is applied to transfer charging blades 74*a* to 74*d* from transfer-bias applying power supplies 75*a* to 75*d*, respectively, charges having a polarity opposite to that of the toner are applied to the backside of the recording material P and the toner images of the respective colors on the surfaces of the photoconductors 1*a* to 1*d* are transferred onto an upper surface of the recording material P in succession. The transfer belt 71 is made of a material P selected as described above.

The toner images of the respective colors formed on the surfaces of the photoconductors 1*a* to 1*d* are transferred onto the recording material P in a superimposed relation by applying the predetermined transfer bias to the transfer charging blades 74*a* to 74*d*. The transfer belt 71 serves also as means for feeding the recording material P to the fusing device 6, and the recording material P departing from the surface of the photoconductor 1*d* is fed to the fusing device 6 by the transfer belt 71.

In this embodiment, a toner density detecting means is realized by forming an image-density measuring test pattern on the photoconductor 1*a* to 1*d* at a position outside the area of an image transferred onto the recording material P, and transferring the test pattern onto the transfer belt 71 at a position outside the image area. Thus, an image density closer to the final image density is obtained, and the toner density is detected by measuring the intensity of light reflected from a toner image of the test pattern.

In the color image forming apparatus, by forming the test pattern on the transfer belt 71 as described above instead of arranging a light-reflecting toner density sensor or a permeability sensor for each of the developing devices 4*a* to 4*d*, a reduction of the cost can be realized because the arrangement of this embodiment requires only one light-reflecting sensor to be provided in association with the transfer belt 71. The test pattern used for detecting the toner density is formed as a check pattern with a coverage of 50% so that a good contrast is achieved with respect to the transfer belt 71. The test pattern has a size of 30 mm in the running direction of the transfer belt 71.

In this embodiment, the test patterns of the respective colors must be formed in the same position in the widthwise direction for reading the test patterns by only one optical sensor provided in association with the transfer belt 71. Also, if the interval between two adjacent recording materials P is increased to excess, the throughput is reduced. Therefore, the test patterns of the respective colors may be formed in any other suitable interval space.

Figure 7A:
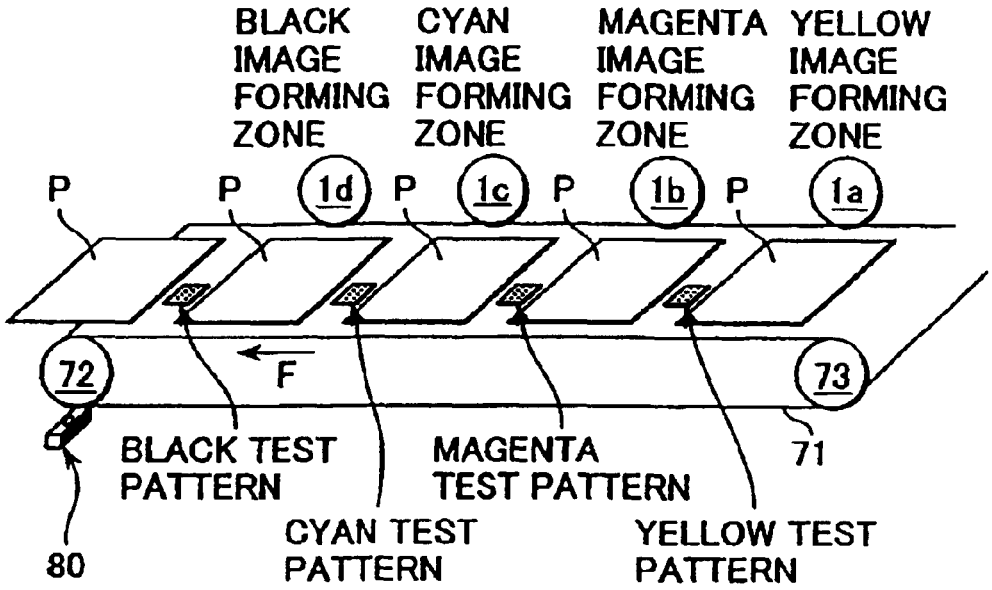
FIGS. 7A and 7B are schematic views showing an embodiment in which test patterns are transferred onto the transfer belt at positions outside image areas.
Figure 7B:
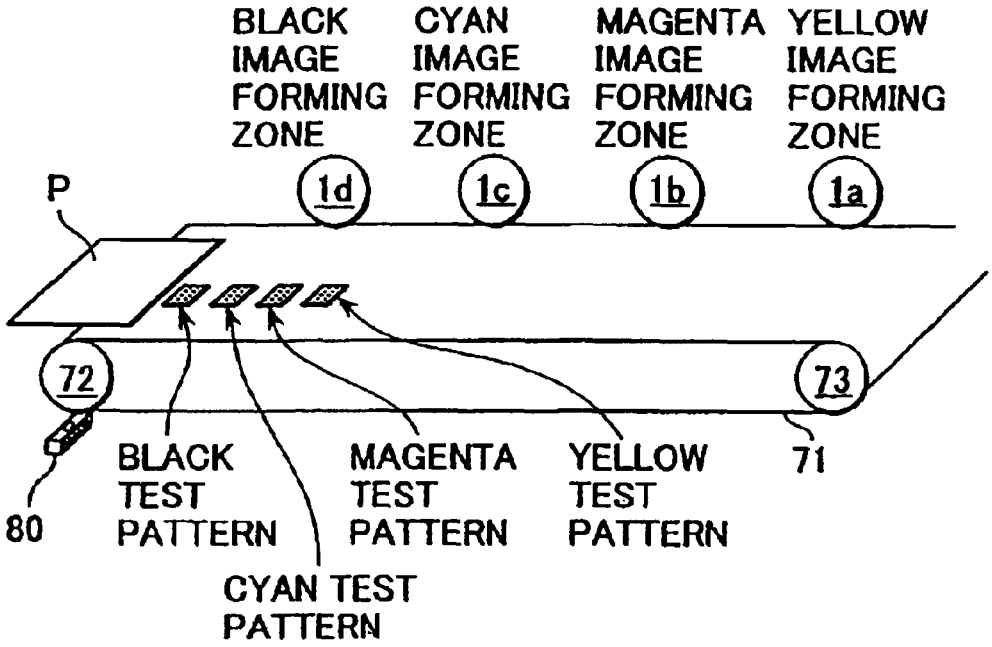

The test patterns of the respective colors are successively formed, by way of example, as shown in FIG. 7A. A black test pattern is transferred onto the transfer belt 71 at a position immediately after an image on a recording material P at the head (referred to as a "first recording material"). A cyan test pattern is transferred onto the transfer belt 71 at a position immediately after an image on a second recording material P. A magenta test pattern is transferred onto the transfer belt 71 at a position immediately after an image on a third recording material P. A yellow test pattern is transferred onto the transfer belt 71 at a position immediately after an image on a fourth recording material P. In the case of non-continuous image formation, as shown in FIG. 7B, the test patterns of the respective colors can be formed in a closely adjacent relation without utilizing the sheet-to-sheet interval.

The test patterns of the respective colors are each formed at a frequency of once per 10 output images so that stability of the image density is ensured. As a sensor for reading the image density, a light-reflecting density sensor 80 is disposed below the drive roller 72. In this embodiment, respective toners are replenished to the developing devices 4*a* to 4*d* depending on outputs of the light-reflecting density sensor 80 corresponding to the test patterns of the respective colors. As a result, the ratio of toner to carriers in each of the developing devices 4*a* to 4*d* is held constant and the image density is stabilized.

The test patterns of the respective colors, from which the image density has been read, pass on the lower run side of the transfer belt 71 and are fed to the transfer area again. In the normal image forming process (in which the toner image is transferred onto the recording material P) and in the process of forming the test patterns, a positive bias having a polarity opposite to that of the charge of the toner image is applied by the transfer-bias applying power supplies 75*a* to 75*d* via the transfer charging blades 74*a* to 74*d* from the backside of the transfer belt 71, causing the toner image of each color having the negative charge polarity to be transferred onto the recording material P. However, at the time when the test pattern of each color passes the transfer nip 70 again, a negative bias having the same polarity as that of the charges of the toner image is applied by corresponding one of the transfer-bias applying power supplies 75*a* to 75*d* via the transfer charging blades 74*a* to 74*d* from the backside of the transfer belt 71. As a result, the test patterns of the respective colors having the negative charge polarity are inversely transferred from the transfer belt 71 onto the surfaces of the photoconductors 1*a* to 1*d*.

The toners forming the inversely transferred test pattern images of the respective colors are reused by the magnetic brushes 3*a* to 3*d* and the 2-component developing device 4*a* to 4*d*, described above, which are provided in the image forming stations for the respective colors.

The step of applying a bias to the transfer charging blades 74*a* to 74*d* is controlled as follows so that the test pattern toner images of the respective colors are inversely transferred in the image forming stations for the respective colors.

A period of one circulation of the transfer belt 71 is time-divided depending on the size of the recording material P designated by a user. In this embodiment, the transfer belt 71 has a peripheral length of 120 mm and a process speed of 100 mm/sec. When the user designates a sheet of A4-size (297×210 mm), the peripheral length of the transfer belt 71 is divided into four image areas each corresponding to 2.1 seconds and four sheet-to-sheet intervals each corresponding to 0.9 second per circulation.

Taking as an example of control of the transfer charging blade 74*d* for the black image forming station, when a test pattern is formed by the control unit once per 10 output images, the transfer charging blade 74*d* is electrically charged with a reversed polarity for 0.3 second (corresponding to the test pattern length of 30 mm in this case) just after the lapse of one circulation period of the transfer belt 71 from the timing at which the formation of the test pattern has been started. Because of a possibility that the toners of other colors may exist in the sheet-to-sheet intervals corresponding to the periods other than the above 0.3-sec period, a positive charging bias (i.e., a bias in a direction causing the negative toner to be transferred to the transfer belt 71 side) is continuously applied to the transfer charging blade 74*d*.

In this connection, the toner images of the test patterns can also be inversely transferred from the transfer belt 71 onto the surfaces of the photoconductors 1*a* to 1*d*, as shown in FIG. 6, by providing a toner polarity reversing unit 150 to reverse the polarity of the charges holding the toner images of the test patterns on the transfer belt 71. More specifically, the polarity of the charges holding the toner image of each test pattern is reversed to be positive by the toner polarity reversing unit 150 before the test pattern passes the transfer nip 70 again. Then, at the time when the test pattern passes the transfer nip 70, a positive bias is applied by the transfer charging blade 74 from the backside of the transfer belt 71. As a result, the toner images of the test patterns can be inversely transferred onto the surfaces of the photoconductors 1*a* to 1*d* from the transfer belt 71.

With the construction and the control described above, a multi-color image forming apparatus can be obtained as one in which the cleaner-less system is realized not only in the image forming stations, but also in the transfer station without color mixing.

Also, as with the second embodiment described above, at the time when a reversed bias is applied by the transfer charging blade 74, the feed speed of the transfer belt 71 may be increased, e.g., 1.5 times as high as the circumferential speed of the photoconductor 1 by controlling the rotational speed of the drive roller 72 with a speed control unit (not shown). With the speed of the transfer belt 71 made higher than that of the photoconductor 1, there occurs a sliding (wiping) action between the transfer belt 71 and the photoconductor 1, whereby the toner image on the transfer belt 71 is dammed by the surface of the photoconductor 1. Further, because electrostatic forces acting to attract the toner image toward the surface of the photoconductor 1 are superimposed, the toner image can be inversely transferred onto the surface of the photoconductor 1 with higher effectiveness.

Fourth Embodiment

The color laser printer described above as the third embodiment is able to perform the normal image forming operation without problems. However, there may occur a drawback in the event that the image forming process is interrupted upon a jam of the recording material (sheet) P.

In view of such a drawback, this fourth embodiment is intended to provide a method of detecting a sheet jam in an image forming apparatus and means for overcoming the drawback, in addition to more detailed explanation of the drawback.

Figure 8:
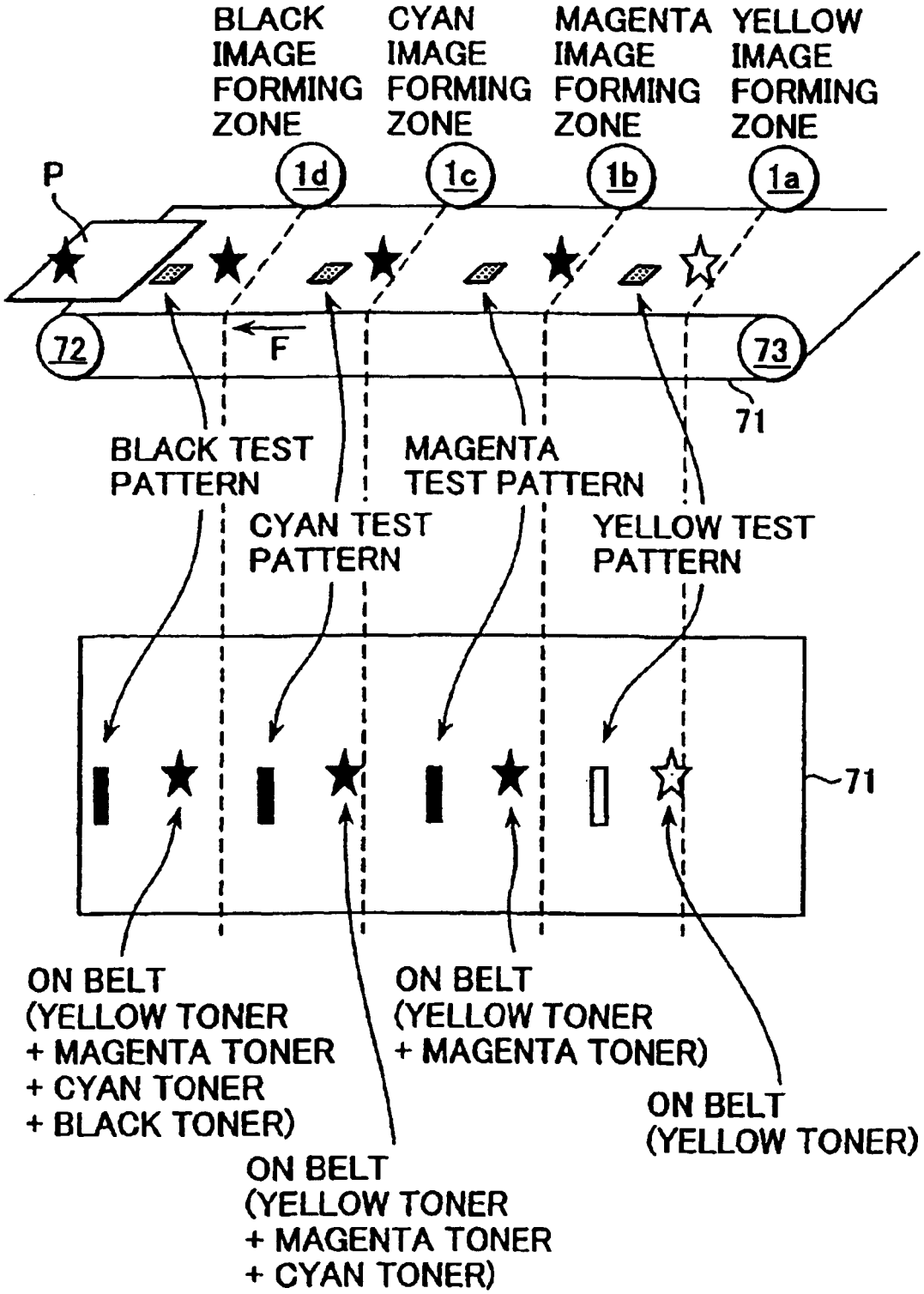
FIG. 8 is a schematic view showing a state in which the transfer belt is automatically stopped upon a sheet jam while test patterns are formed during continuous image formation.

FIG. 8 shows a state in which the transfer belt 71 is automatically stopped upon a sheet jam while the test patterns of the respective colors are formed during the continuous image formation.

As described above with reference to FIG. 6, the image forming stations for the respective colors are arranged in a very compact layout for the purpose of reducing the size of an apparatus body. Further, for the purpose of reducing the cost, sheet jam sensors are not disposed above the transfer belt 71, but are disposed as photo-interrupters at a position (not shown) where the sheet is supplied to the transfer belt 71 and at a position immediately after separation of the sheet from the transfer belt 71. In other words, the control unit 200 of the apparatus does not recognize the occurrence of a sheet jam until it is determined that the sheet does not normally pass the position of the sheet jam sensor at the outlet of the transfer belt 71, even when a sheet jam has occurred after normally passing the position of the sheet jam sensor at the inlet of the transfer belt 71.

More specifically, as shown in FIG. 8, the sheet jam produces toner images on the transfer belt 71. A yellow toner image, which should have been transferred onto the sheet, and a yellow test pattern are present on the transfer belt 71 as leftover toner in an area between a yellow image forming station and a magenta image forming station. A mixed color image of yellow toner and magenta toner, which should have been transferred onto the sheet, and a magenta test pattern are present on the transfer belt 71 as leftover toner in an area between the magenta image forming station and a cyan image forming station. A mixed color image of yellow toner, magenta toner and cyan toner, which should have been transferred onto the sheet, and a cyan test pattern are present on the transfer belt 71 as leftover toner in an area between the cyan image forming station and a black image forming station. Further, a mixed color image of yellow toner, magenta toner, cyan toner and black toner, which should have been transferred onto the sheet, and a black test pattern are present on the transfer belt 71 as leftover toner in an area downstream of the black image forming station.

Thus, if the image formation is interrupted because of the absence of a recording material P, e.g., a sheet of paper, in the event of an abnormal condition, such as a sheet jam, leftover mixed toners of plural colors are directly transferred onto the transfer belt 71 regardless of the arrangement of a group of sheet jam sensors, including one employed in this embodiment. In that event, the user takes an action to eliminate the jammed sheet in accordance with instructions indicated on a display, e.g., a display section of the apparatus body, or specified in manuals, and then performs a restoring operation such as closing a window, a door or the like formed in the apparatus body for coping with the sheet jam, or turning on the power again. Correspondingly, the apparatus body is caused to restore its normal condition.

The control unit 200 of the apparatus body in this embodiment has a memory for storing the fact that a sheet jam has occurred and the timing of occurrence of the sheet jam, and executes the restoring operation from the sheet-jam state after the user has taken the restoring action. In the restoring operation, the leftover toners in the form of mixed-color toner images and single-color toner images of the test patterns, which are present on the transfer belt 71, are recovered in the respective image forming stations as with the third embodiment.

On that occasion, the test pattern toner images of the respective colors and the yellow toner image, which is present on the area between the yellow image forming station and the magenta image forming station and should have been transferred onto the sheet, are recovered from the transfer belt 71 to the image forming stations of the corresponding colors in the same manner as in the third embodiment, i.e., by applying a negative bias having the same polarity as the toner to the transfer charging blades 74*a* to 74*d* at the timing at which the toner images pass the corresponding image forming stations.

On the other hand, the mixed color image of the yellow toner and the magenta toner, which should have been transferred onto the sheet and is present on the transfer belt 71 in the area between the magenta image forming station and the cyan image forming station, the mixed color image of the yellow toner, the magenta toner and the cyan toner, which should have been transferred onto the sheet and is present on the transfer belt 71 in the area between the cyan image forming station and the black image forming station, and the mixed color image of the yellow toner, the magenta toner, the cyan toner and the black toner, which should have been transferred onto the sheet and is present on the transfer belt 71 in the area downstream of the black image forming station, are each a toner image in which the toners of two or more colors are mixed with each other. Accordingly, the image forming station to which the toner is recovered must be selected in view of the mixed colors.

Stated otherwise, for example, if the mixed color toner image containing the black toner and being present downstream of the black image forming station is recovered to the magenta image forming station or the cyan image forming station, there is a possibility that the black toner may be mixed in the magenta toner or the cyan toner and an magenta toner image or a cyan toner image may have a different tint in color in the next image forming process.

In this embodiment, therefore, those leftover toner images of mixed colors are all recovered at the final image forming station, i.e., the black image forming station, (the recovery of the leftover toner images is performed by applying a bias having the same polarity as that of the toner to the transfer charging blade 74*d*). This is because the black toner has a color ideally close to one produced when mixing the yellow, magenta and cyan toners in the same amounts (subtractive color mixing). Thus, the above recovery method causes a minimum effect upon change of the tint.

According to the image forming apparatus of this embodiment, as described above, even when leftover toners are generated on the transfer belt 71 in the event of a sheet jam, for example, not only as the single-color toner images of the test patterns, but also as the general toner images and the mixed color toner images, which should have been transferred onto the recording material, change of the tint can be suppressed to a minimum and a color image forming apparatus can be obtained in which the cleaner-less system is realized in both the image forming stations and the transfer station including the transfer belt 71.

Fifth Embodiment

Figure 9:
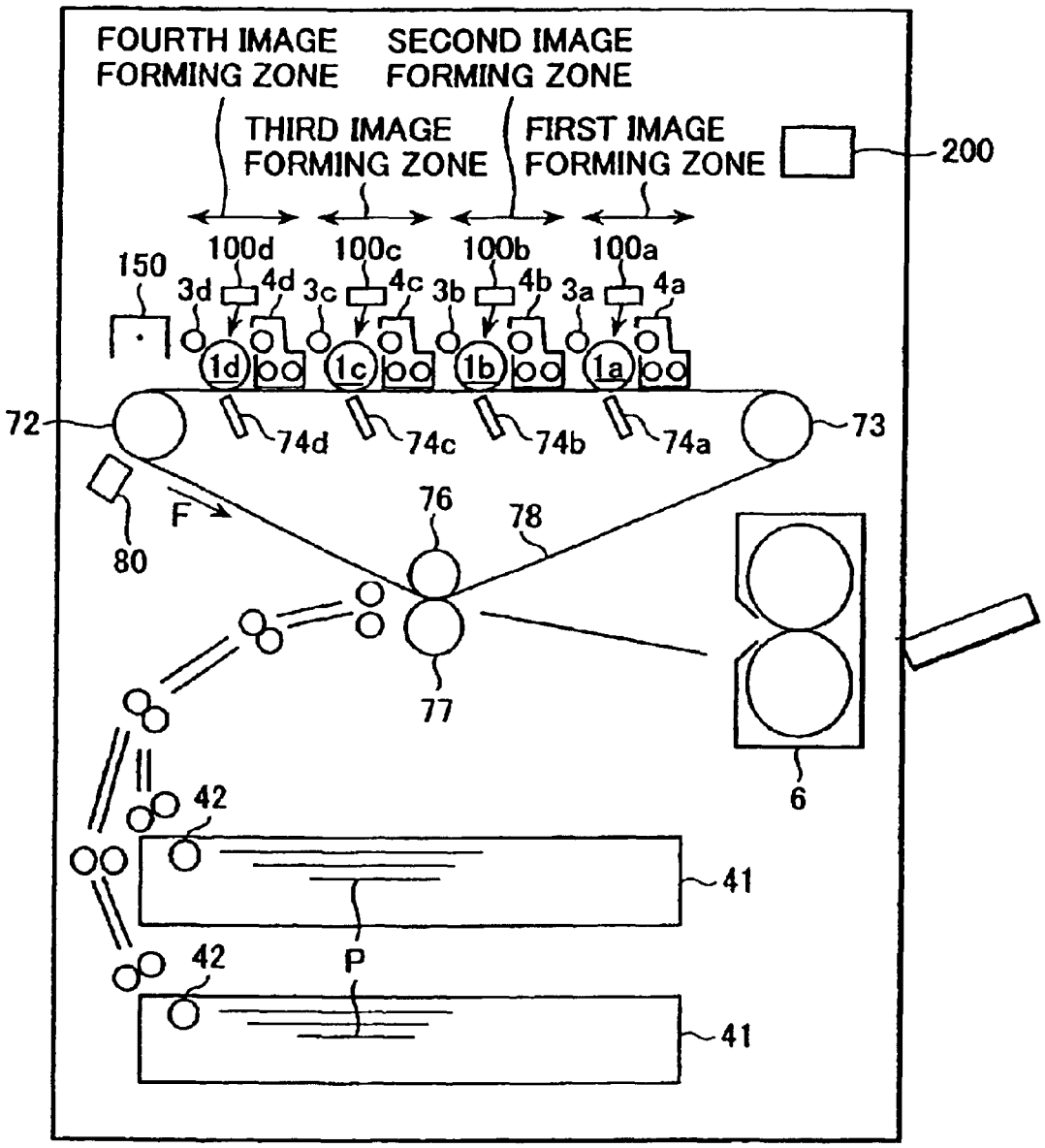
FIG. 9 is a schematic view showing an embodiment in which the image forming apparatus is applied to a color laser beam printer employing an intermediate transfer belt.

FIG. 9 is a schematic view showing, as a fifth embodiment of the image forming apparatus, a color laser beam printer utilizing the electrophotographic process. As with the above embodiments, the image forming apparatus is constituted as a cleaner-less system, and a contact charger in the form of a magnetic brush is employed as a charging means for charging an image carrier. The image forming stations for the respective colors have the same construction and operate in the same manner as those in the third embodiment.

This fifth embodiment employs the so-called intermediate transfer process. More specifically, an intermediate transfer belt 78 serving as an intermediate transfer member (or a transfer medium) is stretched among a drive roller 72, a driven roller 73 and a secondary transfer inner roller 76 to run around those rollers for circulation. An upper run portion of the intermediate transfer belt 78 is contacted with the surfaces of photoconductors 1*a* to 1*d*. By applying a predetermined primary transfer bias from primary transfer charging blades 74*a* to 74*d* to the intermediate transfer belt 78 that is driven by the drive roller 72 to circulate in the direction of arrow F, charges having a polarity opposite to that of the toner are applied to the intermediate transfer belt 78 from the backside thereof and toner images of the respective colors on the surfaces of the photoconductors 1*a* to 1*d* are successively primary-transferred onto an upper surface of the intermediate transfer belt 78. The intermediate transfer belt 78 can be made of a similar material to that used for the transfer belt described above.

A toner image obtained by forming the toner images of the respective colors on the intermediate transfer belt 78 in a superimposed relation is secondary-transferred onto a recording material P by supplying the recording material P so as to pass a nip between the secondary transfer inner roller 76, which is grounded, and a secondary transfer outer roller 77, to which a predetermined bias having a polarity opposite to that of the toner image, in a timed relation to the toner image.

Finally, the recording material P having been subjected to the secondary transfer is fed to a fusing device 6.

In this embodiment, a toner density detecting means is realized by forming an image-density measuring test pattern on the photoconductor 1*a* to 1*d* at a position outside the area of an image transferred onto the recording material P, and transferring the test pattern onto the intermediate transfer belt 78 at a position outside the image area. Thus, an image density closer to the final image density is obtained, and the toner density is detected by measuring the intensity of light reflected from a toner image of the test pattern. The type of the test pattern and the timing and method of reading the test pattern are the same as those in the second embodiment described above.

The test patterns of the respective colors, from which the image density has been read, pass the secondary transfer station and are then fed back to the primary transfer station on the upper run side of the intermediate transfer belt 78. The toner images of the test patterns are each prevented from being transferred onto the secondary transfer outer roller 77 by changing the polarity of the secondary transfer bias from one opposite to that of the toner to the same one during the secondary transfer of the toner image onto the recording material P, or by moving the secondary transfer outer roller 77 away from the intermediate transfer belt 78, when the corresponding test pattern passes the secondary transfer station.

When the test patterns of the respective colors are fed again to the primary transfer station, the transfer charging blades 74*a* to 74*d* apply, to the backside of the intermediate transfer belt 78, the primary transfer bias having the same polarity as that of the toner in one of the image forming stations for the corresponding same color and the primary transfer bias having a polarity opposite to that of the toner in the other image forming stations for the different colors. As a result, the test pattern toner images on the intermediate transfer belt 78 are inversely transferred onto the photoconductors 1*a* to 1*d* for the corresponding colors. Then, the toners forming the inversely transferred test pattern images of the respective colors are reused by the magnetic brushes 3*a* to 3*d* and the 2-component developing device 4*a* to 4*d* which are provided in the image forming stations for the respective colors.

Sixth Embodiment

Figure 10:
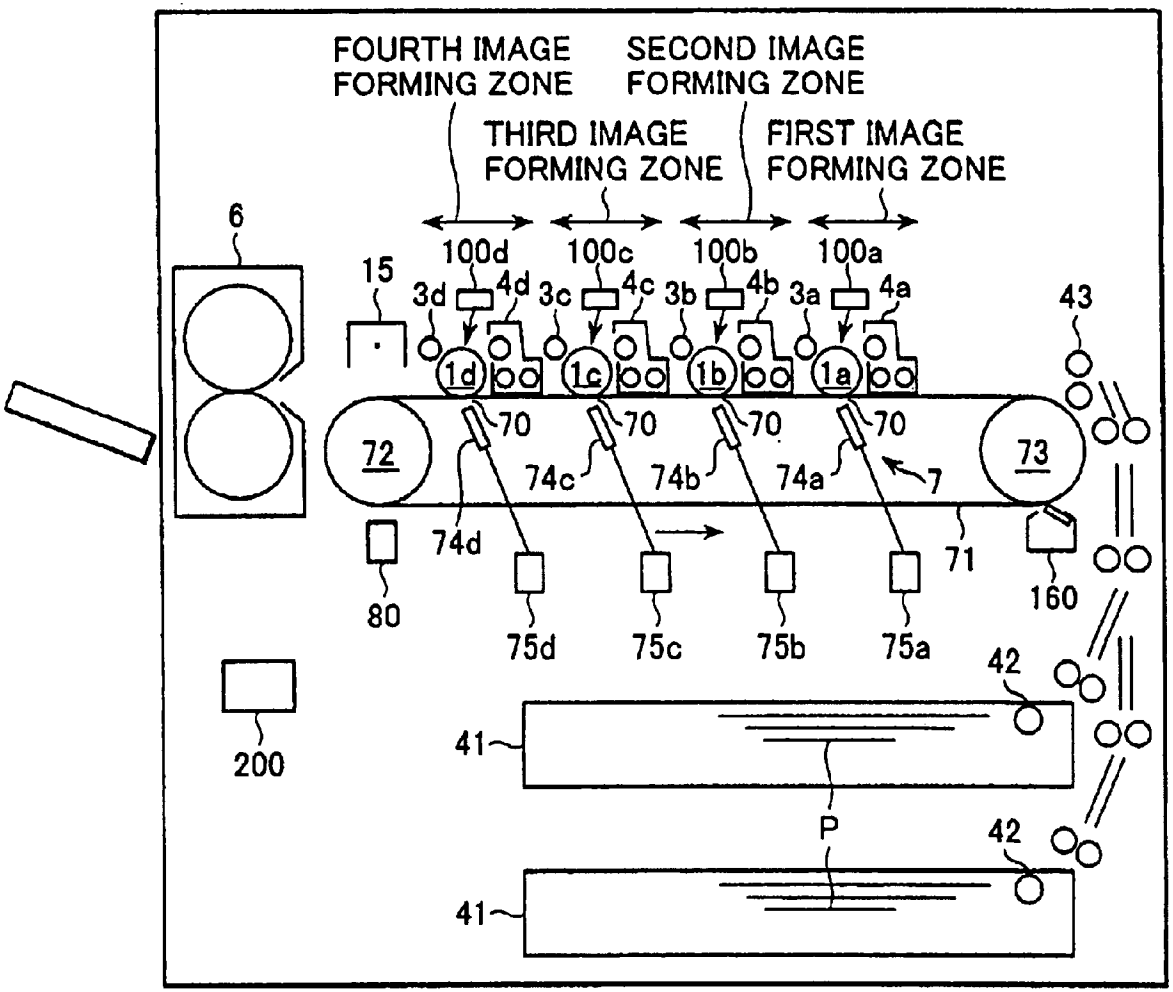
FIG. 10 is a schematic view showing an embodiment of the present invention in which an image forming apparatus employs a transfer belt.

FIG. 10 shows a sixth embodiment of the present invention. This sixth embodiment includes a cleaning unit 160 that is movable toward and away from the transfer belt 71. The cleaning unit 160 recovers, e.g., the after-transfer remaining toner that may cause color mixing if recovered, whereas the toner images of the single-color test patterns are not recovered by the cleaning unit 160 and are inversely transferred onto the image carriers for the respective colors for reuse.

With such an arrangement, since the toners forming the test patterns are reused, the toner utilization factor can be increased. Also, since there is no longer the need of recovering the after-transfer remaining toner of mixed colors in the black image forming station, it is possible to prevent deterioration of image quality occurred in the black image forming station due to color mixing.

The sixth embodiment will be described below in more detail with reference to FIG. 10. The same symbols as those in FIG. 6 denote the same components and hence a description thereof is omitted here.

The cleaning unit 160 is movable to contact with the transfer belt 71 at the timing of cleaning, and away from the transfer belt 71 during the period other than cleaning. The cleaning unit 160 can be constituted, for example, as a cleaning blade made of urethane rubber or the like. However, the cleaning unit 160 is not limited to a particular one so long as it is able to perform the cleaning, and may be in the form of a cleaning brush.

In the event of a sheet jam as shown in FIG. 8, for example, the cleaning unit 160 operates as follows. When the image area (denoted by a star-like mark in FIG. 8), which should have been transferred onto the recording material P, reaches the position of the cleaning unit 160, the cleaning unit 160 is brought into contact with the transfer belt 71 to recover the toner in that image area. When the test patterns of the respective colors between the image areas reach the position of the cleaning unit 160, the cleaning unit 160 is moved away from the transfer belt 71 for passage of the test patterns. Then, the test patterns are inversely transferred onto the image carriers in the image forming stations for the corresponding colors.

With the above-described method, the toners in the image areas (denoted by star-like marks in FIG. 8) are all cleaned by the cleaning unit 160. However, of the image areas, the yellow image area (denoted by a voided star-like mark in FIG. 8) is of a single color. Hence, the toner in the yellow image area may be allowed to pass the cleaning unit 160 without being cleaned by it, and then inversely transferred onto the yellow image carrier for recovery similar to the test pattern.

Figure 11:
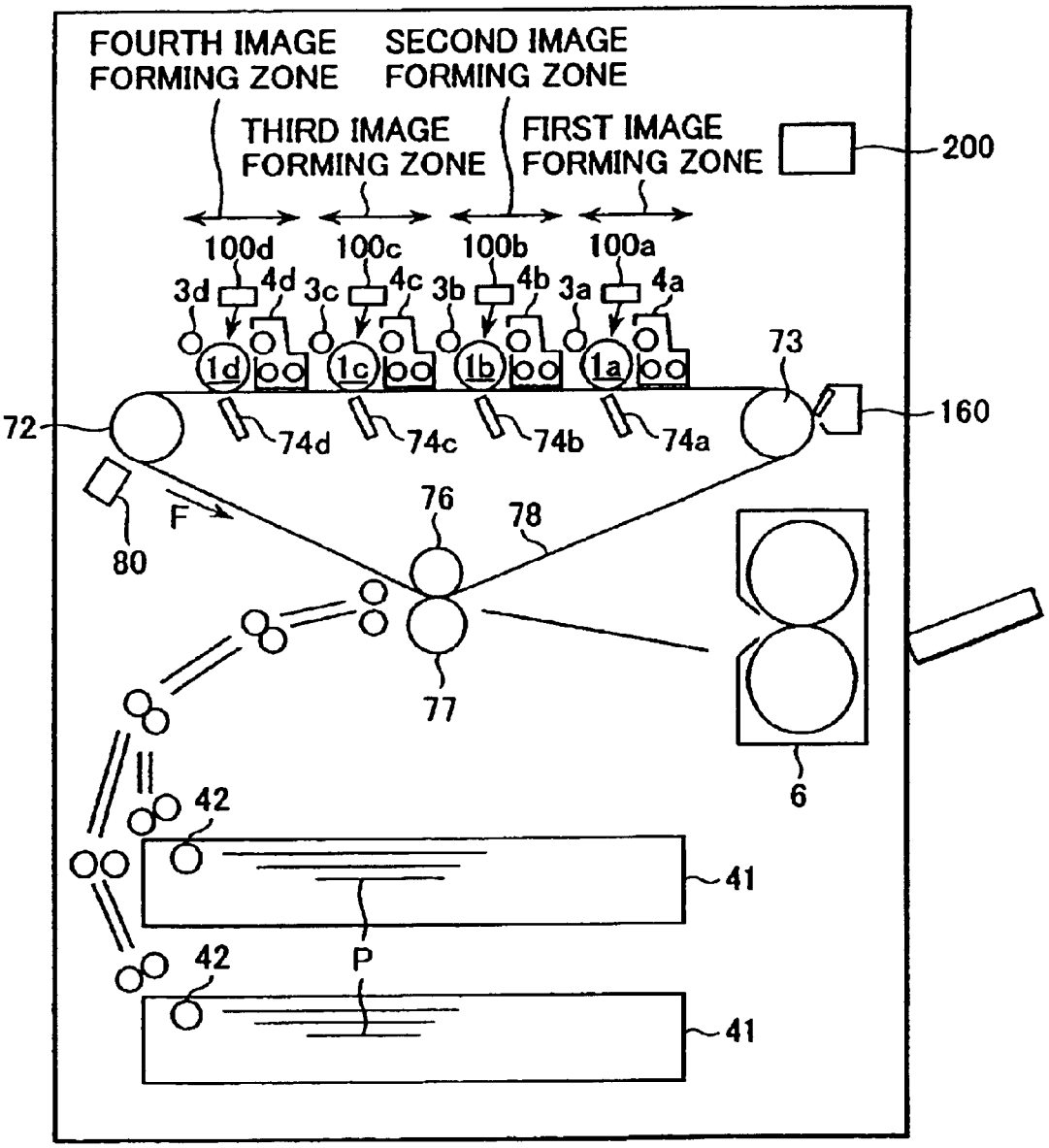
FIG. 11 is a schematic view showing another embodiment of the present invention in which the image forming apparatus employs an intermediate transfer belt.
Figure 12:
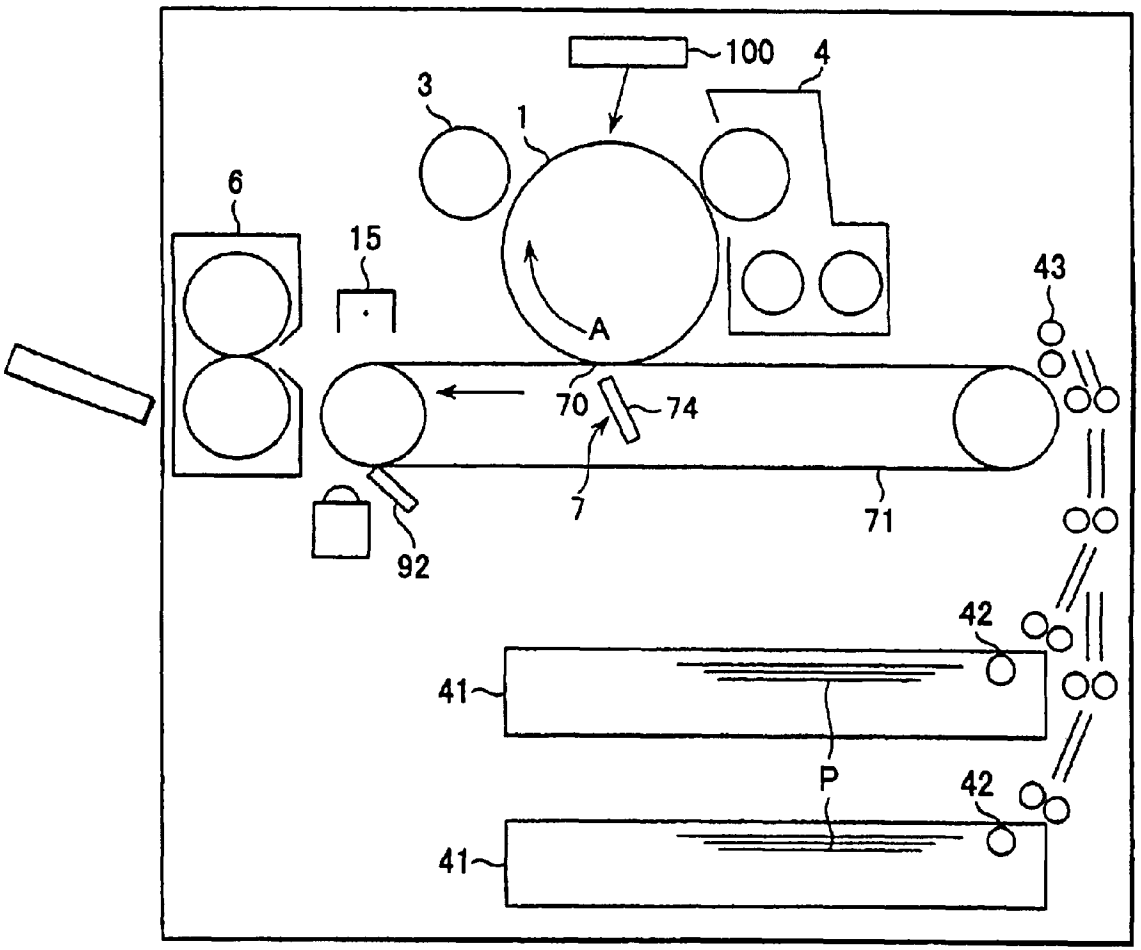
FIG.12 PRIOR ART
FIG. 12 is a schematic view of a conventional image forming apparatus.
Figure 13:
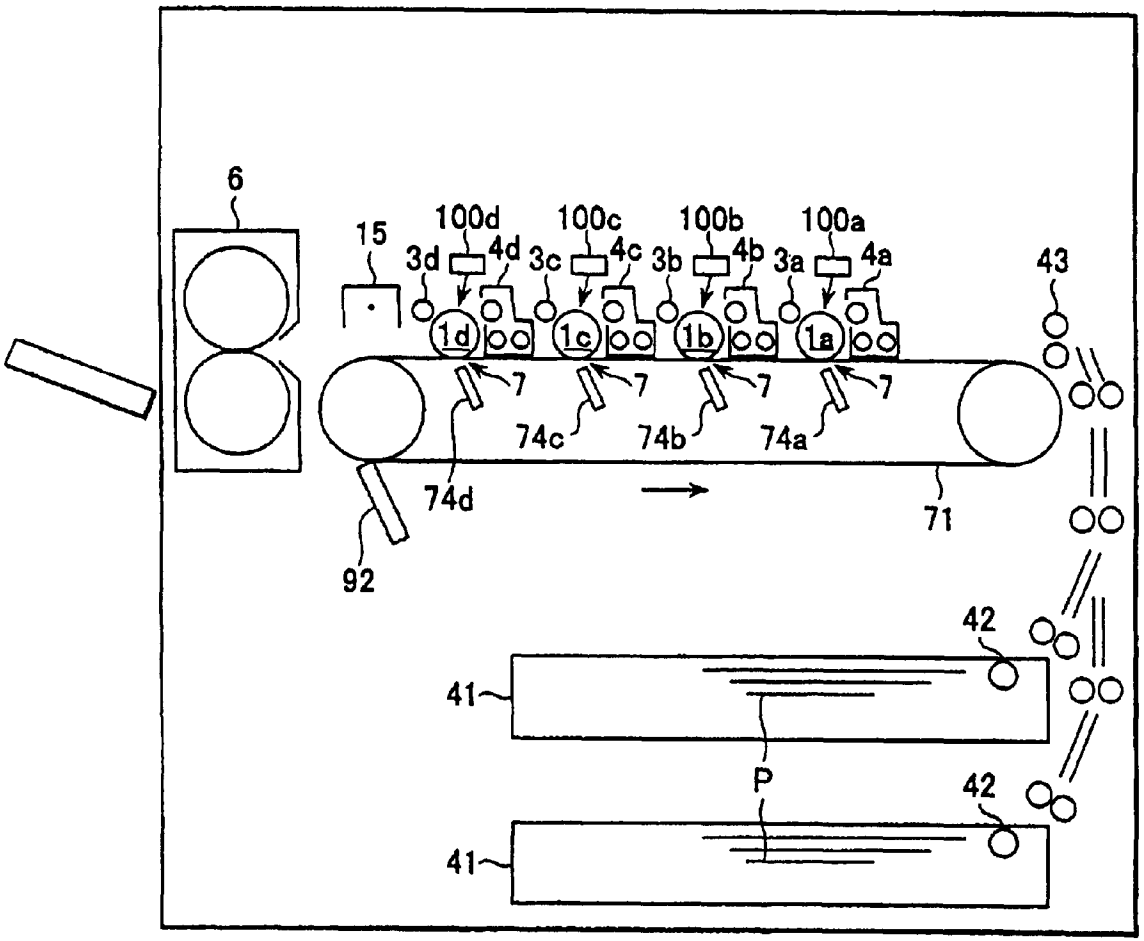
FIG.13 PRIOR ART
FIG. 13 is a schematic view of a conventional color image forming apparatus.

This embodiment is also applicable to the image forming apparatus using the intermediate transfer belt 78 as shown in FIG. 11. More specifically, a cleaning unit 160 is provided to be movable toward and away from the intermediate transfer belt 78. The cleaning unit 160 recovers, e.g., the after-transfer remaining toner that may cause color mixing if recovered, whereas the toner images of the single-color test patterns are not recovered by the cleaning unit 160 and are inversely transferred onto the image carriers for the respective colors for reuse.

Note that the same symbols as those in FIGS. 9 and 10 denote the same components and hence a description thereof is omitted here.

With the arrangement of FIG. 11, when the test patterns are each formed between the image areas, by way of example, as shown in FIG. 7A, the after-transfer remaining toner in the area, in which the toner image has been transferred from the intermediate transfer belt 78 onto the recording material P, is recovered by the cleaning unit 160 because the toner in that area may cause color mixing with a high possibility. On the other hand, because of being single-color toner images, the test patterns are not recovered by the cleaning unit 160, but are inversely transferred onto the image carriers in the image forming stations for the corresponding colors.

In the event that the apparatus is interrupted halfway through the image forming process upon, e.g., a sheet jam and is brought into the condition as shown in FIG. 8, the toner recovery is performed as described below during the circulation for recovery after the restoring process from the sheet jam.

When the image area (denoted by a star-like mark in FIG. 8), which should have been transferred onto the recording material P, reaches the position of the cleaning unit 160, the cleaning unit 160 is brought into contact with the transfer belt 71 to recover the toner in that image area. When the test patterns of the respective colors between the image areas reach the position of the cleaning unit 160, the cleaning unit 160 is moved away from the transfer belt 71 for passage of the test patterns. Then, the test patterns are inversely transferred onto the image carriers in the image forming stations for the corresponding colors. Further, it is preferable that when the after-transfer remaining toner and the test pattern passes the secondary transfer outer roller 77, the toner be prevented from adhering to the secondary transfer outer roller 77 by moving the secondary transfer outer roller 77 away from the intermediate transfer belt 78, or by applying the secondary transfer bias having the same polarity as the toner image.

With the above-described method, the toners in the image areas (denoted by star-like marks in FIG. 8) are all cleaned by the cleaning unit 160. However, of the image areas, the yellow image area (denoted by a voided star-like mark in FIG. 8) is of a single color. Hence, the toner in the yellow image area may be allowed to pass the cleaning unit 160 without being cleaned by it, and then inversely transferred onto the yellow image carrier for recovery similar to the test pattern.

While the above embodiments have been primarily described in connection with the recovery of the test patterns for detecting the toner density, it is a matter of course that the present invention can also be applied to the recovery of test patterns for detecting position shifts.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

electrostatic latent image forming means for forming an electrostatic latent image on a surface of an image carrier;

developing means for developing the electrostatic latent image with toner;

transferring means for transferring a toner image developed by said developing means on the image carrier toward a transfer medium in a transfer area;

test pattern forming means for forming a test pattern, which is made of toner and used for image control, on the transfer medium;

control means for detecting the test pattern and executing image control; and speed control means for controlling a moving speed of the transfer medium, wherein said transferring means transfers the test pattern on the transfer medium, which has been subjected to detection, onto the image carrier, and said developing means collects the test pattern having been transferred onto the image carrier, and wherein said speed control means controls the moving speed of the transfer medium at the time when the test pattern having been subjected to detection is transferred onto the image carrier, to be different from the moving speed of the transfer medium during image formation.

2. An image forming apparatus according to claim 1, wherein said electrostatic latent image forming means comprises;

charging means for electrically charging the surface of the image carrier; and exposure means for exposing, to light, the surface of the image carrier electrically charged by said charging means.

3. An image forming apparatus according to claim 2, wherein the test pattern having been transferred from the transfer medium onto the image carrier is recovered by said charging means, transferred again onto the image carrier, and then recovered by said developing means.

4. An image forming apparatus according to claim 1, wherein when said transferring means transfers the test pattern having been subjected to detection onto the image carrier, charges having the same polarity as that of the toner are applied to the transfer medium.

5. An image forming apparatus according to claim 1, wherein the moving speed of the transfer medium at the time when the test pattern having been subjected to detection is transferred onto the image carrier, is higher than the moving speed of the transfer medium during image formation.

6. An image forming apparatus according to claim 1, further comprising toner polarity reversing means for reversing a polarity of the toner forming the test pattern before the test pattern on the transfer medium is fed again to the transfer area.

7. An image forming apparatus according to claim 1, wherein said developing means comprises a plurality of developing means each having a toner of a different color, and when recovering test patterns, the test patterns are each recovered by one of said plurality of developing means having the same color as that of the toner forming the corresponding test pattern.

8. An image forming apparatus according to claim 1, further comprising cleaning means movable toward and away from the transfer medium, wherein said cleaning means is moved away from the transfer medium at the time when the test pattern having been subjected to detection passes.

9. An image forming apparatus according to claim 1, wherein the transfer medium is a transfer material carrier for supporting and feeding a transfer material, and an image formed on the image carrier is transferred onto the transfer material.

10. An image forming apparatus according to claim 1, wherein the transfer medium is an intermediate transfer member and an image formed on the image carrier is transferred onto a transfer material after having been transferred onto the intermediate transfer member.

11. An image forming apparatus comprising:

a plurality of electrostatic latent image forming means for forming electrostatic latent images on respective surfaces of a plurality of image carriers;

a plurality of developing means for developing the electrostatic latent images on respective ones of the plurality of image carriers with toners of different colors;

a plurality of transferring means for transferring toner images on the respective ones of the plurality of image carriers toward a transfer medium in respective transfer areas;

test pattern forming means for forming test patterns, which are made of toners of different colors and used for image control, on the transfer medium;

control means for detecting the test patterns and executing image control; and speed control means for controlling a moving speed of the transfer medium, wherein said plurality of transferring means transfer the test patterns on the transfer medium, which have been subjected to detection, onto respective ones of the plurality of image carriers corresponding to respective colors of the toners forming the test patterns, and said plurality of developing means associated with the plurality of image carriers, onto which the test patterns have been transferred, collect the corresponding test patterns, and wherein said speed control means controls the moving speed of the transfer medium at the time when the test patterns having been subjected to detection are transferred onto the plurality of image carriers, to be different from the moving speed of the transfer medium during image formation.

12. An image forming apparatus according to claim 11, wherein each of said plurality of electrostatic latent image forming means comprises respectively:

charging means for electrically charging the surface of a respective one of the plurality of image carriers; and exposure means for exposing, to light, the surface of the respective one of the plurality of image carriers electrically charged by said charging means.

13. An image forming apparatus according to claim 12, wherein the test patterns having been transferred from the transfer medium onto the plurality of image carriers are recovered by said charging means, transferred again onto the plurality of image carriers, and then recovered by said plurality of developing means, respectively.

14. An image forming apparatus according to claim 11, wherein when said plurality of transferring means transfer the test patterns having been subjected to detection onto respective ones of the plurality of image carriers, charges having the same polarity as that of the toners are applied to the transfer medium.

15. An image forming apparatus according to claim 11, wherein the moving speed of the transfer medium at the time when the test patterns having been subjected to detection are transferred onto the plurality of image carriers, is higher than the moving speed of the transfer medium during image formation.

16. An image forming apparatus according to claim 11, further comprising toner polarity reversing means for reversing a polarity of the toners forming the test patterns before the test patterns on the transfer medium are fed again to the respective transfer areas.

17. An image forming apparatus according to claim 11, wherein the test patterns are transferred onto respective ones of the plurality of image carriers on which the toner images of the same colors as those of the toners forming the test patterns are formed respectively.

18. An image forming apparatus according to claim 11, further comprising cleaning means movable toward and away from the transfer medium, wherein said cleaning means is moved toward and away from the transfer medium depending on states of the toner images on the transfer medium, and the toner images having passed said cleaning means moved to a position away from the transfer medium are transferred onto specified ones of the plurality of image carriers depending on the state of those toner images and then recovered by developing means of said plurality of developing means of said plurality of developing means associated with the specified ones of the plurality of image carriers onto which those toner images have been transferred.

19. An image forming apparatus according to claim 18, wherein when the toner image is in a state of being formed of single-color toner, said cleaning means is moved away from the transfer medium and that toner image is transferred onto the image carrier of the plurality of image carriers on which the toner image of the same single color is formed, and when the toner image is in a state of being formed of toners of plural colors, said cleaning means is brought into contact with the transfer medium and that toner image is recovered by said cleaning means.

20. An image forming apparatus according to claim 18, wherein when the toner image is in a state of being formed of the test pattern, said cleaning means is moved away from the transfer medium and that toner image is transferred onto the image carrier of the plurality of image carriers on which the toner image of the same color as that of the test pattern is formed.

21. An image forming apparatus according to claim 11, wherein the transfer medium is a transfer material carrier for supporting and feeding a transfer material, and images formed on the plurality of image carriers are transferred onto the transfer material.

22. An image forming apparatus according to claim 11, wherein the transfer medium is an intermediate transfer member and images formed on the plurality of image carriers are transferred onto a transfer material after having been transferred onto the intermediate transfer member.

23. An image forming apparatus comprising;

a plurality of electrostatic latent forming means for forming electrostatic latent images on respective surfaces of a plurality of image carriers;

a plurality of developing means for developing the electrostatic latent images on respective ones of the plurality of image carriers with toners of different colors;

a plurality of transferring means for transferring toner images on the respective ones of the plurality of image carriers toward a transfer medium in respective transfer areas;

test pattern forming means for forming test patterns, which are made of toners of different colors and used for image control, on the transfer medium; and control means for detecting the test patterns and executing image control, wherein said plurality of transferring means transfer the test patterns on the transfer medium, which have been subjected to detection, onto respective ones of the plurality of image carriers corresponding to respective colors of the toners forming the test patterns, and said plurality of developing means associated with the plurality of image carriers, onto which the test patterns have been transferred, collect the corresponding test patterns, and wherein in a restoring operation performed after an image forming process is stopped in the event of an abnormal condition, the toner images on the transfer medium are transferred onto specified ones of the plurality of image carriers depending on states of the toner images, and then collected by developing means of said plurality of developing means associated with the specified ones of the plurality of image carriers onto which the toner images have been transferred.

24. An image forming apparatus according to claim 23, wherein when the toner image is in a state of being formed of single-color toner, that toner image is transferred onto the image carrier of the plurality of image carriers on which the toner image of the same single color is formed, and when the toner image is in a state of being formed of toners of plural colors, that toner image is transferred onto the image carrier of the plurality of image carriers on which a black toner image is formed.

* * * * *

UNITED STATES PATENT AND TRADEMARK OFFICE

CERTIFICATE OF CORRECTION

PATENT NO. : 6,804,479 B2
DATED : October 12, 2004
INVENTOR(S) : Yoichi Kimura

It is certified that error appears in the above-identified patent and that said Letters Patent is hereby corrected as shown below:

Column 8,
Line 66, “With” should read -- with --.

Column 10,
Line 5, “electrosatically” should read -- electrostatically --.

Column 18,
Line 13, “to which” should read -- which has --.

Column 23,
Line 9, “of said plurality of developing” should be deleted.
Line 10, “means” should be deleted.

Signed and Sealed this

Fifteenth Day of February, 2005

JON W. DUDAS
*Director of the United States Patent and Trademark Office*